US011065749B2

(12) United States Patent
Knight et al.

(10) Patent No.: US 11,065,749 B2
(45) Date of Patent: Jul. 20, 2021

(54) POWERED FASTENER DRIVER

(71) Applicant: TTI (MACAO COMMERCIAL OFFSHORE) LIMITED, Macau (MO)

(72) Inventors: Tyler Knight, Greenville, SC (US); Miles R. Moody, Greenville, SC (US); J. Luke Jenkins, Williamston, SC (US); Matthew W. Conner, Greenville, SC (US); William E. Sadkowski, Belton, SC (US); Reid Cheatham, Greenville, SC (US); Justin Moylan, Easley, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 176 days.

(21) Appl. No.: 16/363,635

(22) Filed: Mar. 25, 2019

(65) Prior Publication Data

US 2019/0291253 A1 Sep. 26, 2019

Related U.S. Application Data

(60) Provisional application No. 62/667,898, filed on May 7, 2018, provisional application No. 62/648,086, filed on Mar. 26, 2018.

(51) Int. Cl.
*B25C 1/04* (2006.01)
*B25C 1/00* (2006.01)

(52) U.S. Cl.
CPC ..... *B25C 1/043* (2013.01); *B25C 1/008* (2013.01); *B25C 1/047* (2013.01); *B25C 1/005* (2013.01)

(58) Field of Classification Search
CPC ..... B25C 1/043; B25C 1/047; B25C 1/008
USPC ..... 227/130
See application file for complete search history.

(56) References Cited

U.S. PATENT DOCUMENTS

| | | | | |
|---|---|---|---|---|
| 3,784,077 | A * | 1/1974 | Burke, Jr. | B25C 1/008 227/8 |
| 3,964,659 | A | 6/1976 | Eiben et al. | |
| 4,298,072 | A | 11/1981 | Baker et al. | |
| 5,105,329 | A | 4/1992 | Goldner | |
| 5,366,132 | A * | 11/1994 | Simonelli | B25C 1/008 227/130 |

(Continued)

FOREIGN PATENT DOCUMENTS

| | | |
|---|---|---|
| EP | 2801447 | 11/2014 |
| EP | 3257632 | 12/2017 |
| WO | 2018100939 | 6/2018 |

*Primary Examiner* — Nathaniel C Chukwurah
(74) *Attorney, Agent, or Firm* — Michael Best & Friedrich LLP

(57) ABSTRACT

A pneumatic fastener driver is operable in a single sequential mode and a bump-fire mode. The pneumatic fastener driver includes a housing, a nosepiece extending from the housing from which fasteners are ejected, and a trigger moveable between a default position, in which a drive cycle is inhibited from initiating, and a depressed position, in which the drive cycle is permitted to be initiated. The pneumatic fastener driver further includes a contact arm movable relative to the nosepiece between an extended position and a retracted position, and a timeout mechanism operable in the bump-fire mode to inhibit the drive cycle from being initiated in response to inactivity of the contact arm over a preset time interval that begins once the trigger is actuated from the default position to the depressed position.

20 Claims, 35 Drawing Sheets

(56) References Cited

U.S. PATENT DOCUMENTS 5,772,096 A * 6/1998 Osuka ..... B25C 1/008 227/130
6,431,425 B1 8/2002 Moorman et al.
6,604,664 B2 8/2003 Robinson
6,607,111 B2 8/2003 Garvis et al.
6,669,072 B2 12/2003 Burke et al.
6,755,336 B2 6/2004 Harper et al.
6,796,475 B2 9/2004 Adams
6,974,061 B2 12/2005 Adams et al.
7,051,913 B2 5/2006 Chuang
7,163,134 B2 1/2007 Moeller et al.
7,201,301 B2 4/2007 Moeller et al.
7,284,511 B2 10/2007 Zahner et al.
7,341,171 B2 3/2008 Moeller et al.
7,383,974 B2 6/2008 Moeller et al.
7,431,185 B2 10/2008 Moeller et al.
7,487,898 B2 2/2009 Moeller et al.
7,494,037 B2 2/2009 Simonelli et al.
7,497,271 B2 3/2009 Moeller et al.
7,510,105 B2 3/2009 Moeller et al.
7,513,402 B2 4/2009 Miyashita et al.
7,673,779 B2 3/2010 Moeller et al.
7,861,905 B2 1/2011 Miescher et al.
7,918,374 B2 4/2011 Gardner et al.
7,938,305 B2 5/2011 Simonelli et al.
8,011,441 B2 9/2011 Leimbach et al.
8,011,547 B2 9/2011 Leimbach et al.
8,167,182 B2 5/2012 Shima et al.
8,191,751 B2 6/2012 Moeller et al.
8,230,941 B2 7/2012 Leimbach et al.
8,267,296 B2 9/2012 Leimbach et al.
8,267,297 B2 9/2012 Leimbach et al.
8,282,328 B2 10/2012 Gardner et al.
8,286,722 B2 10/2012 Leimbach et al.
8,313,012 B2 11/2012 Shima et al.
8,387,718 B2 3/2013 Leimbach et al.
8,413,867 B2 4/2013 Gardner et al.
8,464,921 B2 6/2013 Shima et al.
8,505,798 B2 8/2013 Simonelli et al.
8,602,282 B2 12/2013 Leimbach et al.
8,622,271 B2 1/2014 Shima et al.
8,763,874 B2 7/2014 McCardle et al.
8,939,340 B2 1/2015 Gardner et al.
9,381,633 B2 7/2016 Moore et al.
9,550,288 B2 1/2017 Moore et al.
9,643,306 B2 5/2017 Largo et al.
9,662,776 B2 5/2017 Puppala et al.
9,676,088 B2 6/2017 Leimbach
9,782,880 B2 10/2017 Moore et al.
2014/0263535 A1 9/2014 Rajani et al.
2015/0298308 A1 10/2015 Kato
2015/0314432 A1 11/2015 Yang et al.
2016/0114470 A1 4/2016 Weigmann et al.
2016/0136797 A1 5/2016 Weigmann et al.
2016/0207185 A1 7/2016 Garber et al.
2017/0129084 A1 5/2017 Moore et al.
2017/0173771 A1 5/2017 Grandjean et al.
2017/0266795 A1 9/2017 Lai
2017/0266796 A1 9/2017 Leimbach et al.
2018/0117747 A1 5/2018 Hahndel
2018/0117748 A1 5/2018 Ishikawa et al.

* cited by examiner

POWERED FASTENER DRIVER

CROSS-REFERENCE TO RELATED APPLICATIONS

This application claims priority to U.S. Provisional Patent Application No. 62/667,898 filed on May 7, 2018, and U.S. Provisional Patent Application No. 62/648,086 filed on Mar. 26, 2018, the entire contents of both of which are incorporated herein by reference.

FIELD OF THE INVENTION

The present invention relates to a power tool, and more particularly to a powered fastener driver.

BACKGROUND OF THE INVENTION

Powered fastener drivers are used to drive fasteners (e.g., nails, tacks, staples, etc.) into a workpiece. Such fastener drivers may be powered by compressed air generated by an air compressor, for example.

SUMMARY OF THE INVENTION

The invention provides, in one aspect, a pneumatic fastener driver operable in a single sequential mode and a bump-fire mode. The pneumatic fastener driver includes a housing, a nosepiece extending from the housing from which fasteners are ejected, a trigger moveable between a default position, in which a drive cycle is inhibited from initiating, and a depressed position, in which the drive cycle is permitted to be initiated, a contact arm movable relative to the nosepiece between an extended position and a retracted position, and a timeout mechanism operable in the bump-fire mode to inhibit the drive cycle from being initiated in response to inactivity of the contact arm over a preset time interval that begins once the trigger is actuated from the default position to the depressed position.

The invention provides, in another aspect, a pneumatic fastener driver operable in a single sequential mode and a bump-fire mode. The pneumatic fastener driver includes a housing, a nosepiece extending from the housing from which fasteners are ejected, a trigger moveable between a default position, in which a drive cycle is inhibited from initiating, and a depressed position, in which the drive cycle is permitted to be initiated, a contact arm movable relative to the nosepiece between an extended position and a retracted position, and a timeout mechanism operable in the bump-fire mode to inhibit actuation of the contact arm towards the retracted position in response to inactivity of the contact arm over a preset time interval that begins once the trigger is actuated from the default position to the depressed position.

The invention provides, in another aspect, a pneumatic fastener driver operable in a single sequential mode and a bump-fire mode. The pneumatic fastener driver includes a housing, a nosepiece extending from the housing from which fasteners are ejected, a trigger moveable between a default position, in which a drive cycle is inhibited from initiating, and a depressed position, in which the drive cycle is permitted to be initiated, a contact arm movable relative to the nosepiece between an extended position and a retracted position, and a timeout mechanism operable in the bump-fire mode to inhibit the drive cycle from being initiated in response to inactivity of the contact arm over a preset time interval defined by unwinding of a mainspring that is initially wound in response to the trigger being actuated from the default position to the depressed position. The pneumatic fastener driver also includes a counting assembly having a gear train driven by the mainspring and an escapement wheel that decrementally controls the unwinding of the mainspring over the preset time interval.

The invention provides, in another aspect, a pneumatic fastener driver operable in a single sequential mode and a bump-fire mode. The pneumatic fastener driver includes a housing, a nosepiece extending from the housing from which fasteners are ejected, a trigger moveable between a default position, in which a drive cycle is inhibited from initiating, and a depressed position, in which the drive cycle is permitted to be initiated, a contact arm movable relative to the nosepiece between an extended position and a retracted position, and a timeout mechanism operable in the bump-fire mode to inhibit the drive cycle from being initiated in response to inactivity of the contact arm over a preset time interval defined by unwinding of a mainspring that is initially wound in response to the trigger being actuated from the default position to the depressed position. The pneumatic fastener driver also includes a counting assembly having a gear train driven by the mainspring and a gas spring assembly that decrementally controls the unwinding of the mainspring over the preset time interval.

The invention provides, in another aspect, a pneumatic fastener driver operable in a single sequential mode and a bump-fire mode. The pneumatic fastener driver includes a housing, a nosepiece extending from the housing from which fasteners are ejected, a drive mechanism having a drive blade reciprocably driven through the nosepiece to eject fasteners, a trigger moveable between a default position, in which a drive cycle is inhibited from initiating, and a depressed position, in which the drive cycle is permitted to be initiated, a trigger valve assembly adjacent the trigger and operable to release an airflow to atmosphere when the trigger is actuated to the depressed position, causing the drive mechanism to actuate, a contact arm movable relative to the nosepiece between an extended position and a retracted position, and a timeout mechanism operable in the bump-fire mode to inhibit the airflow through the trigger valve assembly in response to inactivity of the contact arm over a preset time interval that begins once the trigger is actuated from the default position to the depressed position.

The invention provides, in another aspect, a pneumatic fastener driver operable in a single sequential mode and a bump-fire mode. The pneumatic fastener driver includes a housing, a nosepiece extending from the housing from which fasteners are ejected, a trigger moveable between a default position, in which a drive cycle is inhibited from initiating, and a depressed position, in which the drive cycle is permitted to be initiated, a contact arm movable relative to the nosepiece between an extended position and a retracted position, and a timeout mechanism operable in the bump-fire mode to inhibit the drive cycle from being initiated in response to inactivity of the contact arm over a preset time interval defined by unwinding of a mainspring that is initially wound in response to the trigger being actuated from the default position to the depressed position. The pneumatic fastener driver also includes a counting assembly having a female barrel pivotably coupled to a pivot shaft of the trigger and driven by the mainspring and a lockout linkage coupled to the female barrel that is capable of interfering with a portion of the trigger.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
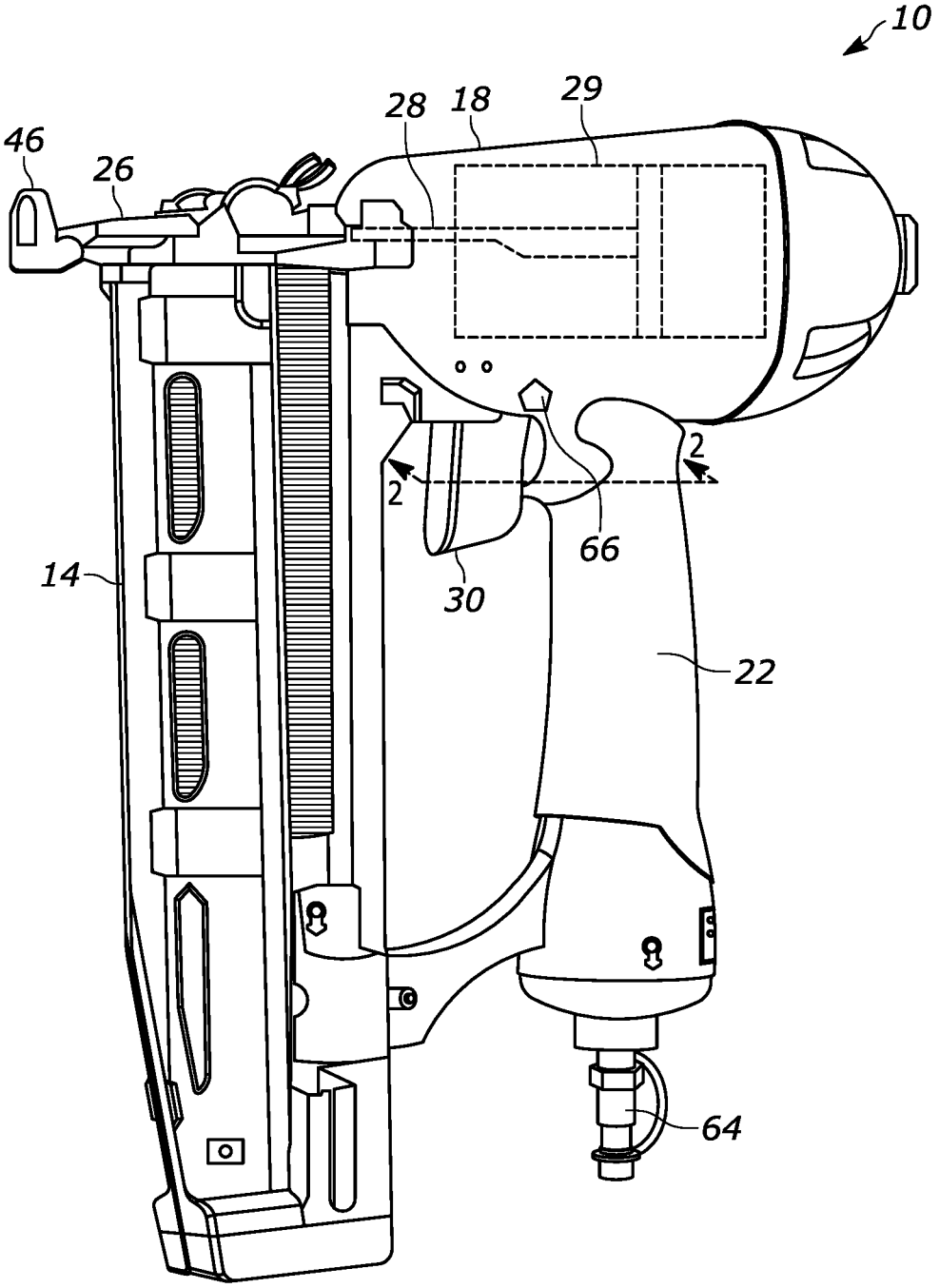
FIG. 1 is a perspective view of a powered fastener driver in accordance with an embodiment of the invention.

With reference to FIG. 1, a fastener driver 10 is operable to drive fasteners (e.g., nails, tacks, staples, etc.) held within a magazine 14 into a workpiece. The fastener driver 10 includes a housing 18 with a handle portion 22, a nosepiece 26 extending from the housing 18 from which the fasteners are ejected, and a drive blade 28 movable in a reciprocating manner within the nosepiece 26 for discharging the fasteners from the magazine 14. The fastener driver 10 also includes a drive mechanism 29 disposed within the housing 18 for reciprocating the drive blade 28 through consecutive drive cycles. Each drive cycle discharges a single fastener from the magazine 14 at the nosepiece 26 and driven into a workpiece. In some embodiments, the drive mechanism 29 includes an on-board air compressor that generates pressurized air that applies a force to drive the drive blade 28 via a head valve (not shown). In other embodiments, the drive mechanism 29 may include a compression spring or a gas spring for applying a force on the drive blade 28. In yet other embodiments, the drive mechanism 29 may include a remote power source (e.g., an external source of pressurized air) for applying a force on the drive blade 28.

Figure 2:
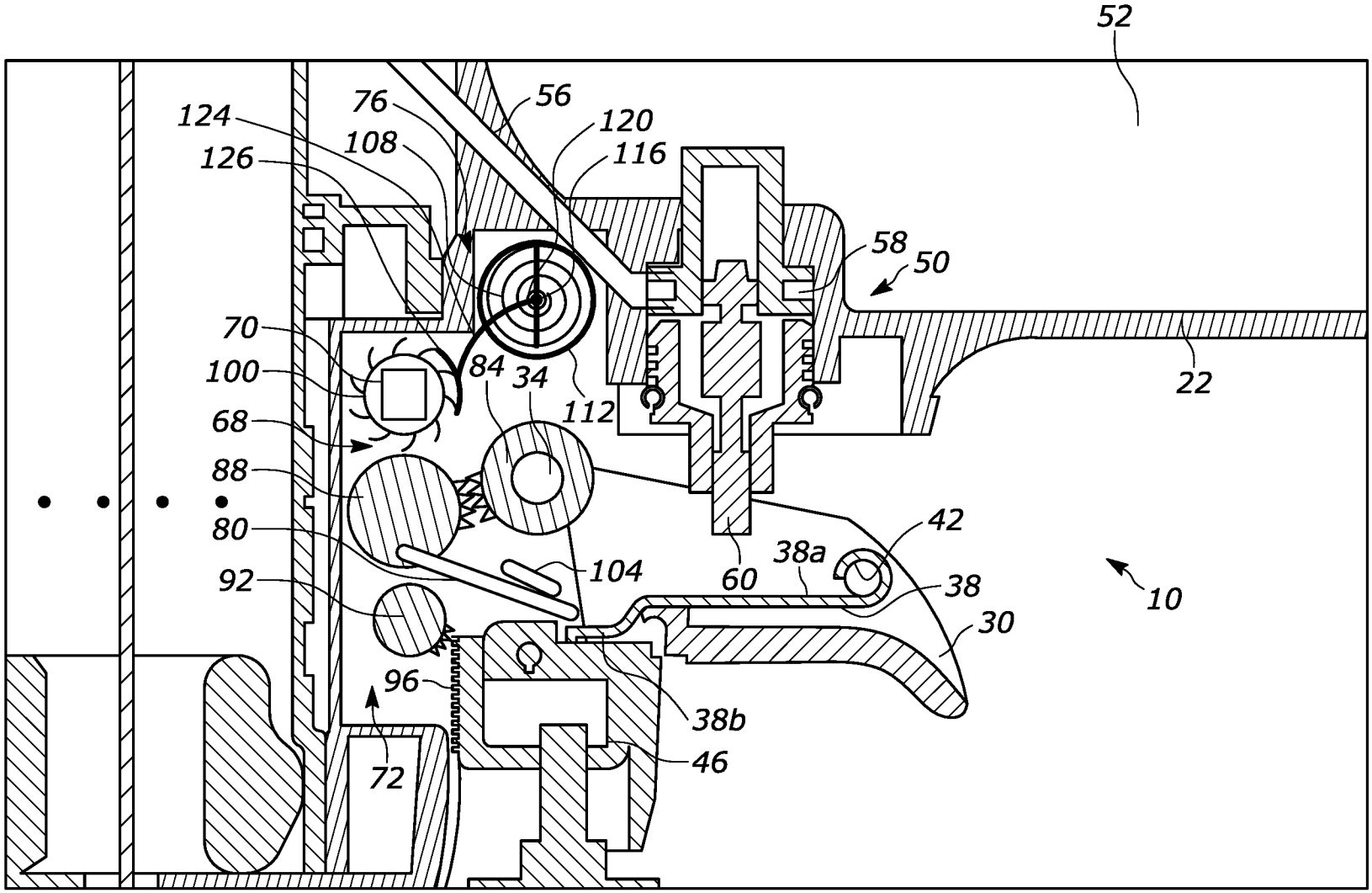
FIG. 2 is a cross-sectional view of a portion of the powered fastener driver along line 2-2 of FIG. 1, illustrating a timeout mechanism in an expired state, an activation trigger in a default position, and a contact arm in an extended position.

With reference to FIGS. 1 and 2, the fastener driver 10 further includes an activation trigger 30 disposed adjacent the handle portion 22 that is user-actuated to begin each drive cycle. Specifically, the trigger 30 is movable from a default position (FIG. 1) to a depressed position (FIG. 3) to initiate the drive cycle. The activation trigger 30 is biased toward the default position by a biasing element, such as a spring. In the illustrated embodiment, the trigger 30 pivots about a pivot shaft 34 (FIG. 2) when moving between the default and depressed positions. An operator grasps the handle portion 22 to hold the driver 10 while using a finger to actuate the trigger 30. The trigger 30 includes a trigger arm 38 that is supported on the trigger 30 via a pin 42. The trigger arm 38 is supported on and pivots about the pin 42. The trigger arm 38 includes a central portion 38*a* and a distal end portion 38*b*.

Figure 4:
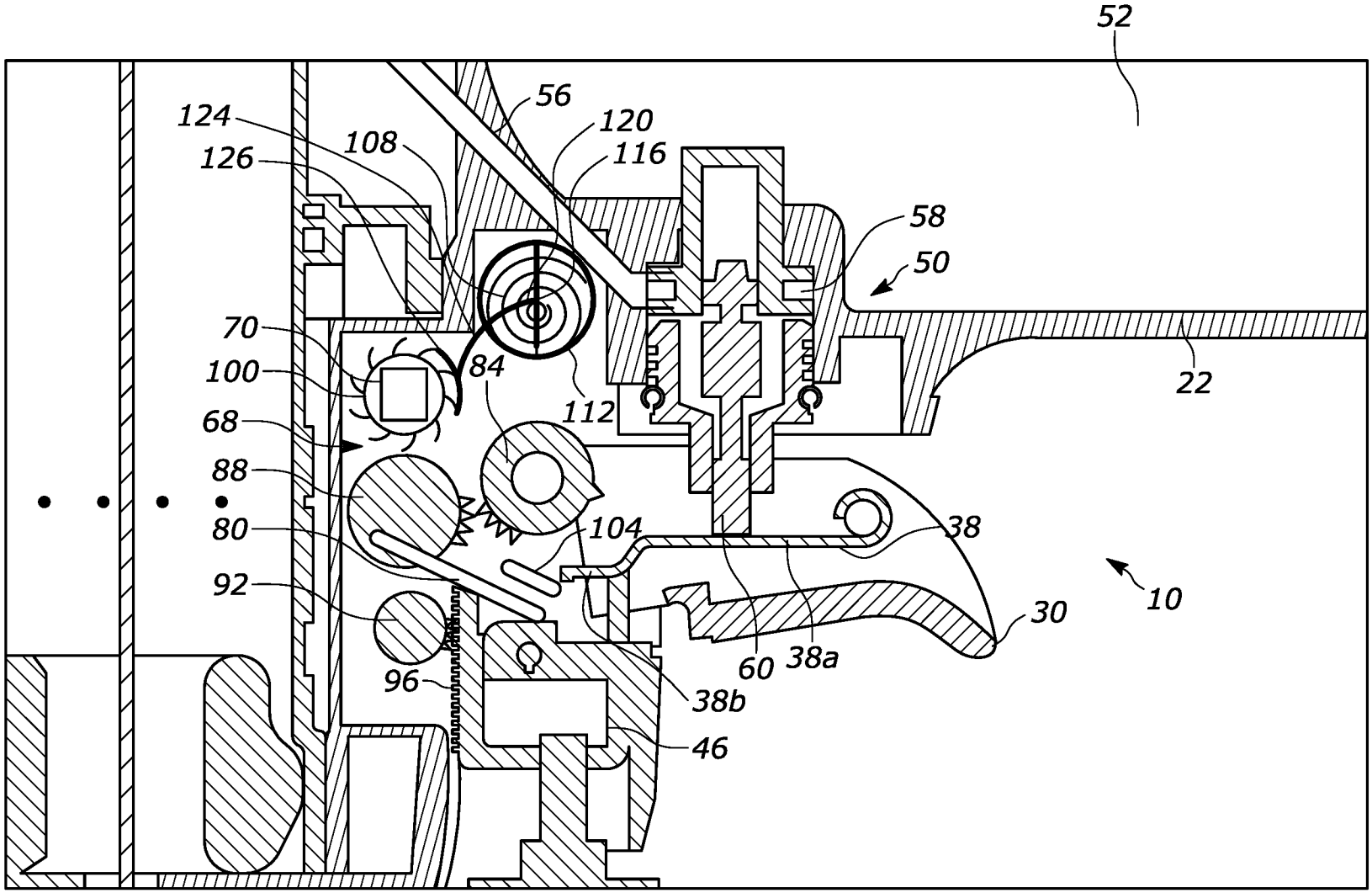
FIG. 4 is a cross-sectional view of the powered fastener driver of FIG. 2, illustrating the timeout mechanism in the unexpired state, the activation trigger in a depressed position, and the contact arm in a retracted position.

The fastener driver 10 further includes a contact arm 46 (FIG. 1) slidable relative to the nosepiece 26 in response to contacting a workpiece. The contact arm 46 is also movable between a biased, extended position in which fasteners are inhibited from being discharged from the magazine 14, and a retracted position in which fasteners are permitted to be discharged from the magazine 14. In the illustrated embodiment, the contact arm 46 mechanically interfaces with the activation trigger 30 to selectively permit a drive cycle to be initiated. Specifically, the contact arm 46 engages the distal end portion 38*b* of the trigger arm 38 in order for a drive cycle to be initiated, as shown in FIG. 4.

With reference to FIG. 2, the fastener driver 10 also includes a trigger valve assembly 50 disposed adjacent the activation trigger 30. High air pressure is released to atmosphere (i.e., atmospheric pressure) through the trigger valve assembly 50 when the activation trigger 30 is actuated, causing the head valve (not shown) to actuate and allowing compressed air stored in the handle portion 22 to drive the drive blade 28. The trigger valve assembly 50 is supported by the handle portion 22 adjacent the activation trigger 30. The fastener driver 10 includes a first or air supply chamber 52, a main air passage 56, and a second or trigger air chamber 58 fluidly connecting the air supply chamber 52 and the main air passage 56. At least a portion of the trigger valve assembly 50 is housed within the trigger air chamber 58 and interposed between the air supply chamber 52 and the main air passage 56. The air supply chamber 52 receives and collects pressurized fluid from an external air compressor via a hose connect 64 (FIG. 1).

The trigger valve assembly 50 further includes a valve stem 60 (FIG. 2) capable of being depressed upon actuation of the activation trigger 30. Specifically, the central portion 38*a* of the trigger arm 38 engages the valve stem 60 in order to depress the valve stem 60 when the activation trigger 30 is actuated, as shown in FIG. 4. The valve stem 60 is nested and reciprocates within the trigger air chamber 58, such that the valve stem 60 selectively opens the trigger valve assembly 50 to atmosphere. The valve stem 60 is urged toward a default position (FIGS. 2 and 3) by a biasing member, such as a spring.

With reference to FIGS. 2-6, the fastener drive 10 further includes a timeout mechanism 68 that is operable to lock the trigger 30, and more specifically the trigger arm 38, from being actuated in response to inactivity (i.e., lack of actuation) of the contact arm 46 over a preset time interval that begins once the trigger 30 is initially depressed, as described in further detail below. The timeout mechanism 68 is disposed within the housing 18 and includes a gear train 72, a mainspring 70 for driving the gear train 72, a hairspring or counting assembly 76 to control the release of energy from the mainspring 70, and a lockout linkage 80 capable of interfacing with the distal end portion 38*b* of the trigger arm 38. The gear train 72 includes a trigger gear 84 disposed about the pivot shaft 34 of the trigger 30, an intermediate gear 88 intermeshed with and driven by the trigger gear 84, a rack gear 92 selectively intermeshed with a rack 96 on the contact arm 46 and the intermediate gear 88, and an escapement wheel 100 that interacts with the hairspring assembly 76. The lockout linkage 80 has one end pivotably coupled to the intermediate gear 88 and an opposite free end capable of interfering with the distal end portion 38*b* of the trigger arm 38. A support wall 104 on the housing 18 is disposed adjacent the lockout linkage 80 and prevents the lockout linkage 80 from pivoting upward beyond the orientation shown in FIG. 2.

With continued reference to FIGS. 2-6, the hairspring assembly 76 includes a hairspring 108, a balance wheel 112 coupled to and driven by the hairspring 108, a balance axle 116 about which the balance wheel 112 rotates, and a roller 120 offset from the balance axle 116. The hairspring assembly 76 further includes a palette lever 124 that intermittently receives the roller 120 at one end as the balance wheel 112 oscillates, while the other end of the palette lever 124 intermittently engages with the escapement wheel 100 via a palette crossarm 126. The hairspring assembly 76 alternately checks and releases the gear train 72 by a fixed amount and transmits a periodic impulse from the mainspring 70 to the balance wheel 112. The hairspring assembly 76 is similar to a traditional hairspring assembly that is well-known in the watch making industry and the field of horology.

In operation, the fastener driver 10 is operable in two modes of operation—a first or single sequential mode (FIG. 6) and a second or bump-fire mode (FIGS. 2-5). In sequential mode, an operator first presses the contact arm 46 against a workpiece, causing it to retract, and then presses the activation trigger 30 to initiate a drive cycle for discharging a fastener from the magazine 14. In contrast, bump-fire mode allows an operator to first actuate the activation trigger 30 from the default position to the depressed position, and thereafter, initiate a drive cycle each time the contact arm 46 is retracted coinciding with being depressed against a workpiece. In order to switch the fastener driver 10 between the two modes of operation, the fastener driver 10 is provided with a knob 66 (FIG. 1) having a cammed surface that moves the trigger 30 (and therefore the trigger arm 38) relative to the valve stem 60, thereby altering the spatial relationship therebetween to affect how a drive cycle is initiated.

Figure 3:
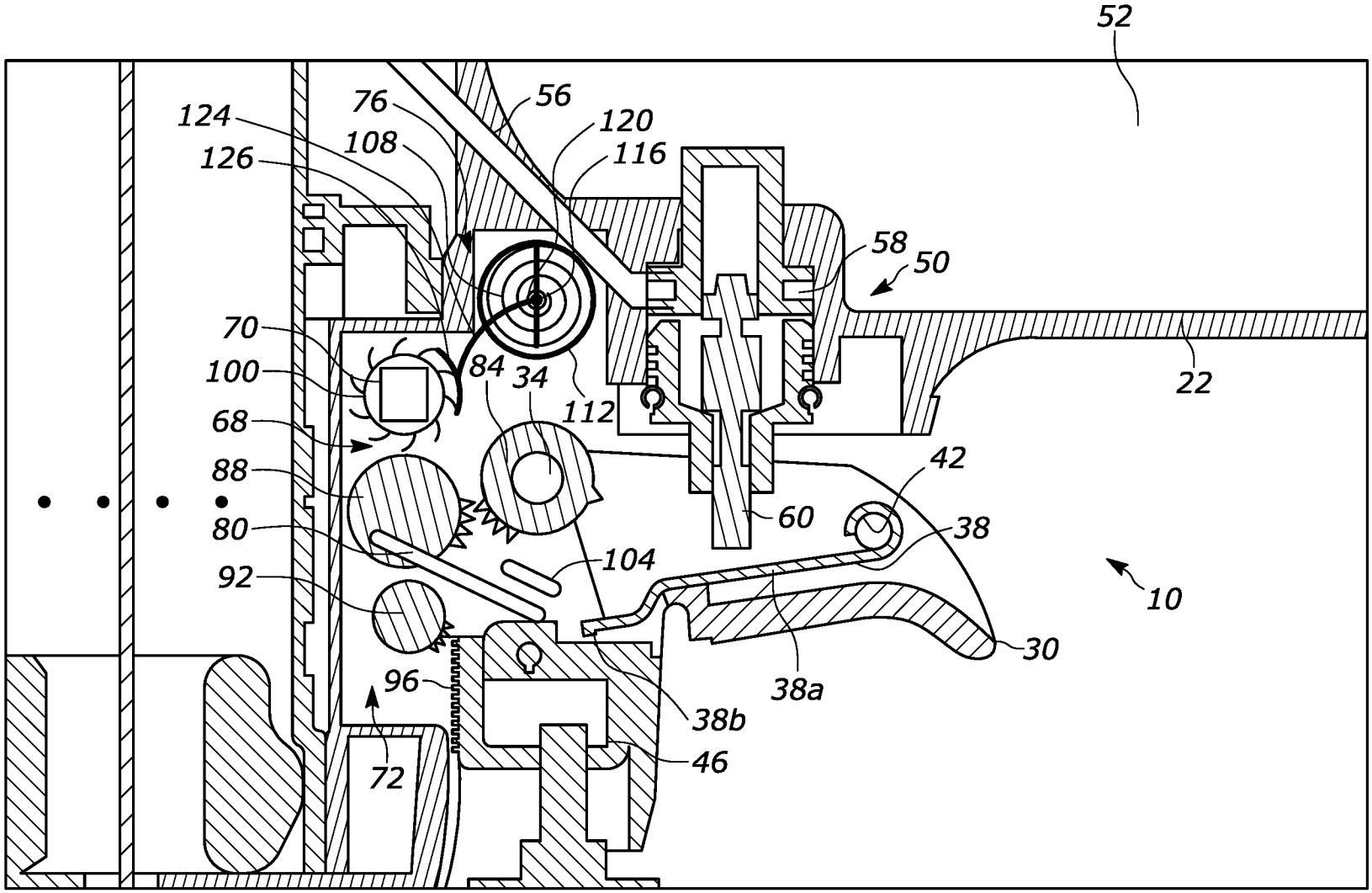
FIG. 3 is a cross-sectional view of the powered fastener driver of FIG. 2, illustrating the timeout mechanism in an unexpired state, the activation trigger in a depressed position, and the contact arm in the extended position.

While the fastener driver 10 is in bump-fire mode, the timeout mechanism 68 limits the amount of time an operator has to initiate a drive cycle (i.e., depress the contact arm 46 against a workpiece) after the trigger 30 is actuated to the depressed position. As illustrated in FIG. 2, the trigger gear 84 is intermeshed with the intermediate gear 88 and the lockout linkage 80 is adjacent the distal end portion 38*b* of the trigger arm 38. At this point, the mainspring 70 is unwound, and thus the gear train 72 is in an expired state. By actuating the trigger 30 to the depressed position as illustrated in FIG. 3, the trigger gear 84 co-rotates with the trigger 30 in a counter-clockwise direction, which ultimately winds the mainspring 70 and places the gear train 72 in an unexpired state. Specifically, rotation of the trigger gear 84 causes the following sequence of events to simultaneously occur: (a) rotation of the intermediate gear 88 in a clockwise direction; (b) rotation of the rack gear 92 in a counter-clockwise direction; (c) rotation of the escapement wheel 100 in a counter-clockwise direction; and (d) separation of the lockout linkage 80 and the distal end portion 38*b* of the trigger arm 38 such that interference therebetween no longer exists (FIG. 3). The mainspring 70 and the gear train 72 are fully wound, thereby starting the preset time interval during which the operator is permitted to initiate the drive cycle. In the event the operator depresses the contact arm 46 against a workpiece (i.e., initiates the drive cycle) as illustrated in FIG. 4, the contact arm 46 contacts the distal end portion 38*b* of the trigger arm 38, causing rotation of the trigger arm 38 towards the valve stem 60 at which point the central portion 38*a* of the trigger arm 38 actuates the valve stem 60. Subsequently, the drive mechanism 29 drives the drive blade 28 to discharge a fastener through the nosepiece 26 and into the workpiece. By doing so, the rack 96 of the contact arm 46 is displaced into mesh engagement with the rack gear 92 to again cause rotation of the rack gear 92 in the counter-clockwise direction. This time, rotation of the rack gear 92 rotates the intermediate gear 88 in the clockwise direction, thereby resetting the timeout mechanism 68 as the mainspring 70 and gear train 72 are fully rewound again.

Figure 5:
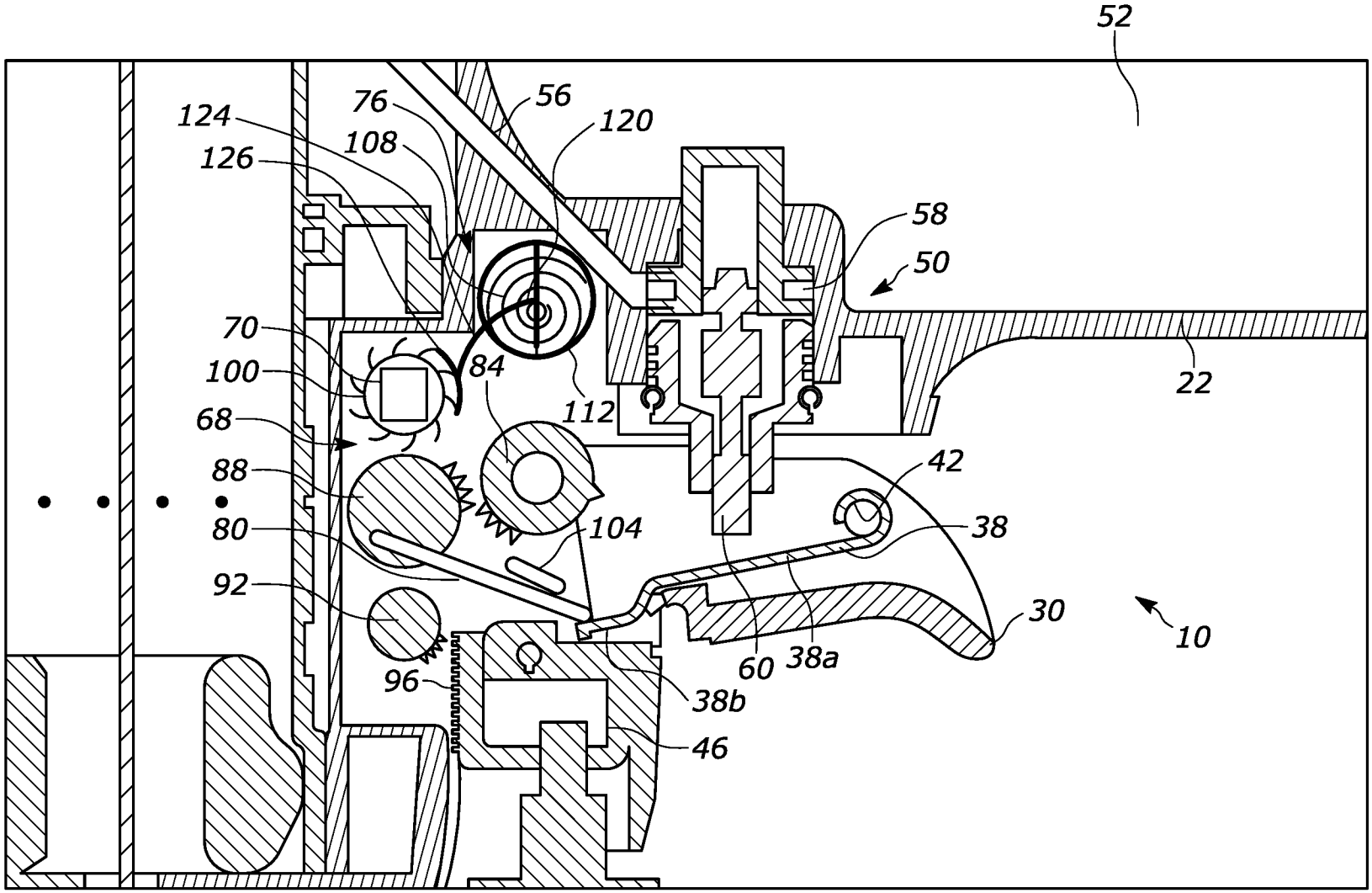
FIG. 5 is a cross-sectional view of the powered fastener driver of FIG. 2, illustrating the timeout mechanism in the expired state, the activation trigger in a depressed position, and the contact arm in the extended position.
Figure 6:
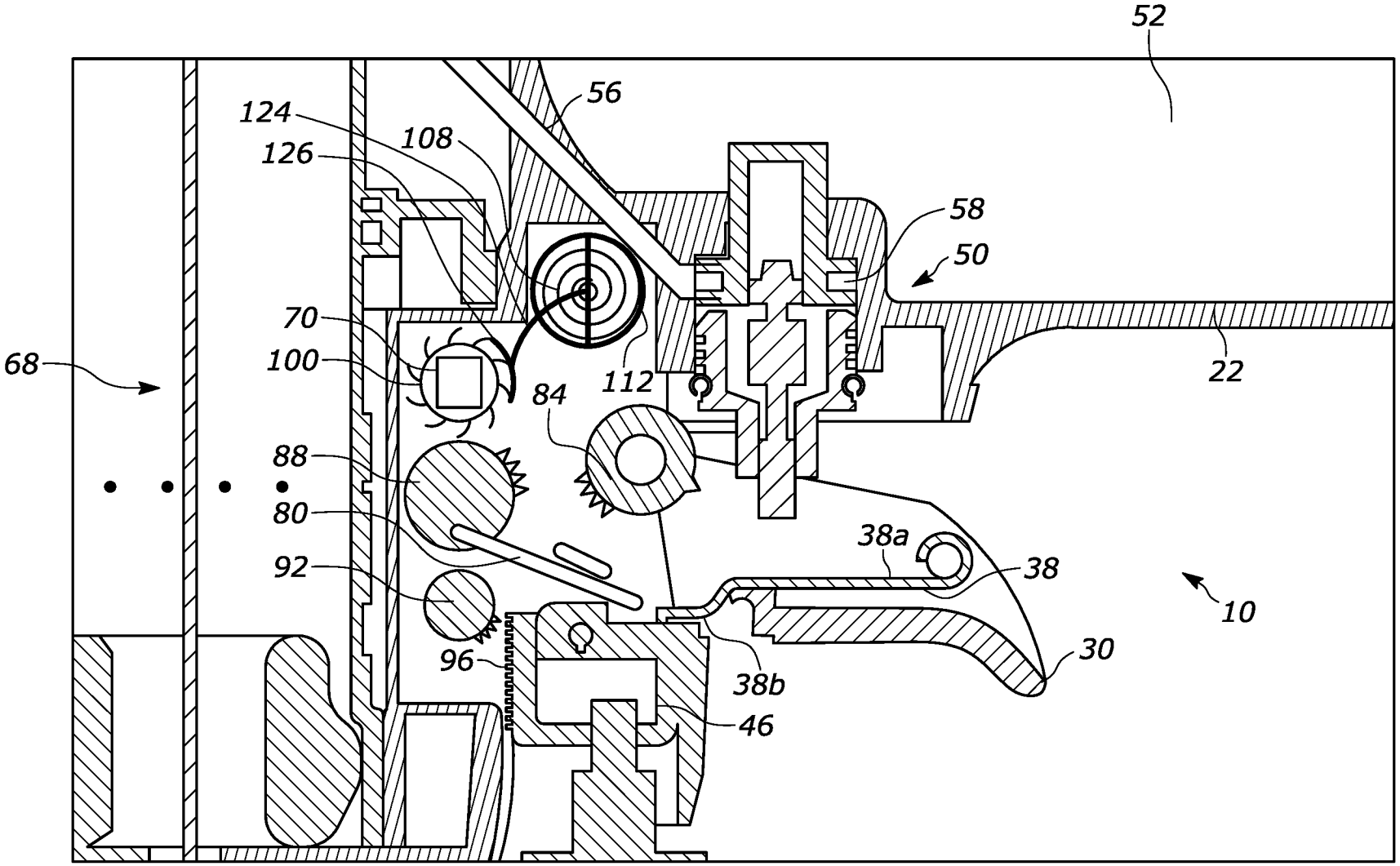
FIG. 6 is a cross-sectional view of the powered fastener driver of FIG. 2, illustrating the timeout mechanism disengaged from the activation trigger.

Now, in the event the operator fails to depresses the contact arm 46 against a workpiece (i.e., initiates the drive cycle) within the preset time interval, the lockout linkage 80, which itself is prevented from pivoting upward by the support wall 104, mechanically interferes with the distal end portion 38*b* of the trigger arm 38 at which point the trigger arm 38 is no longer pivotable to actuate of the valve stem 60, as illustrated in FIG. 5. The support wall 104 inhibits the contact arm 46 from pivoting both the lockout linkage 80 and the trigger arm 38 if an attempt is made to depress the contact arm 46 after expiration of the preset time interval. At the beginning of the preset time interval, the mainspring 70 and gear train 72 are fully wound and the timeout mechanism 68 is thereby set in motion. The mainspring 70 and the gear train 72 are slowly unwound over the preset time interval via the hairspring assembly 76, which acts to count the preset time interval. In other words, the hairspring assembly 76 operates to release the stored energy of the mainspring 70 in a controlled manner. The escapement wheel 100 gradually rotates along with the gear train 72; however, the palette crossarm 126 checks and releases each tooth of the escapement wheel 100 causing intermittent motion of the escapement wheel 100. The act of checking and releasing via the palette crossarm 126 causes the palette lever 124 to sway as the palette lever 124 catches and throws the roller 120 of the balance wheel 112. The balance wheel 112 is now set in an perpetual oscillating motion as the hairspring 108 momentarily stores the energy (i.e., rotational energy) exerted on the balance wheel 112 and releases similar, almost equal energy back to the balance wheel 112 to rotate in the opposite direction. The roller 120 is caught by the palette lever 124 causing the palette lever 124 to sway back where an adjacent tooth of the escapement wheel 100 is checked and released by the palette crossarm 126. The aforementioned sequence of events related to the hairspring assembly 76 continues until the mainspring 70 is completely unwound and no more energy is transmitted through the gear train 72; thus, expiring the preset time interval.

When the fastener driver 10 is in the sequential mode (FIG. 6), the timeout mechanism 68 is disengaged from the trigger 30 such that the operator is not required to initiate the drive cycle within the preset time interval defined by the timeout mechanism 68. By placing the fastener driver 10 in sequential mode, the trigger 30 is displaced relative to the handle portion 22 via the cammed surface of the knob 66. Accordingly, the trigger gear 84 is also displaced relative to the intermediate gear 88 such that the gears 84, 88 are no longer intermeshed. Also, the lockout linkage 80 is no longer in proximity to interfere with the trigger arm 38 of the trigger 30. Thus, the timeout mechanism 68 is disabled when the fastener driver 10 is in the sequential mode. During operation of the fastener driver 10 in sequential mode, compressed air at high pressure is maintained within the air supply chamber 52 prior to the activation trigger 30 being actuated towards the depressed position. Air from the supply chamber 52 is guided into the trigger air chamber 58 and the main air passage 56. Once the contact arm 46 and the activation trigger 30 (and therefore the valve stem 60) is actuated to the depressed position, the trigger air chamber 58 opens to atmosphere as air exits the trigger valve assembly 50, allowing the head valve (not shown) to actuate and causing the compressed air from the air supply chamber 52 to actuate the drive mechanism 29 and the drive blade 28.

Figure 7:
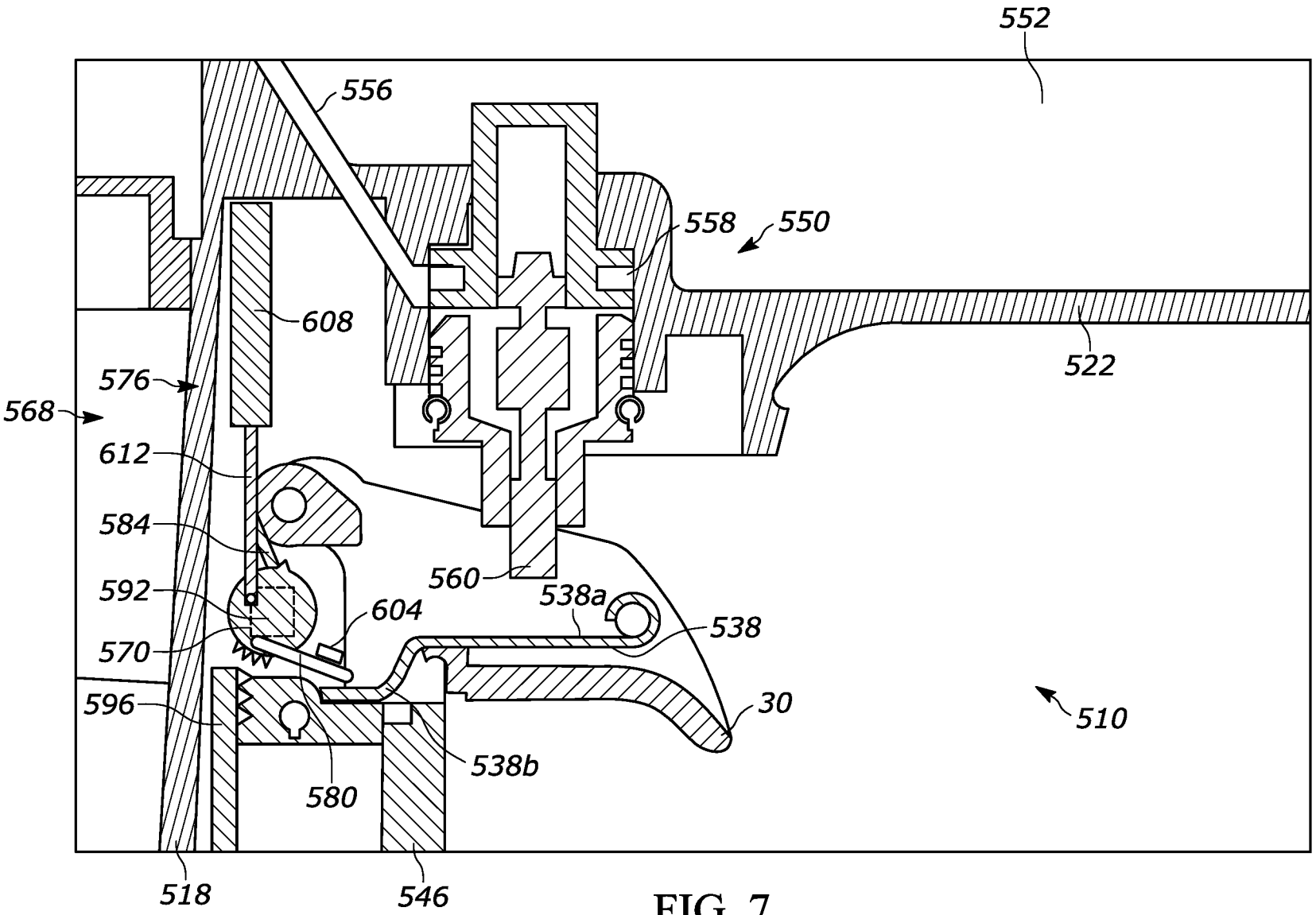
FIG. 7 is a cross-sectional view of a portion of a powered fastener driver in accordance with another embodiment along line 2-2 of FIG. 1, illustrating a timeout mechanism in an expired state, an activation trigger in a default position, and a contact arm in an extended position.

FIG. 7 illustrates a fastener driver 510 in accordance with another embodiment of the invention. The fastener driver 510 includes a timeout mechanism 568 operable to inhibit a drive cycle, but is otherwise similar to the fastener driver 10 described above with reference to FIGS. 1-6, with like components being shown with like reference numerals plus 500. Differences between the fastener drivers 10, 510 are described below.

The fastener driver 510 includes a housing 518 with a handle portion 522, an activation trigger 530, a contact arm 546, and a trigger valve assembly 550. The activation trigger 530 is disposed adjacent the handle portion 522 and is user-actuated from a default position (FIG. 7) to a depressed position (FIG. 8) to initiate the drive cycle to begin each drive cycle. The contact arm 546 is also movable between a biased, extended position in which fasteners are inhibited from being discharged from the magazine 14, and a retracted position in which fasteners are permitted to be discharged from the magazine 14. In the illustrated embodiment, the contact arm 546 mechanically interfaces with the activation trigger 530 to selectively permit a drive cycle to be initiated. The trigger valve assembly 550 is disposed adjacent the activation trigger 530. High air pressure is released to atmosphere (i.e., atmospheric pressure) through the trigger valve assembly 550 via the valve stem 560 when the activation trigger 530 is actuated, causing the head valve (not shown) to actuate and allowing compressed air stored in the handle portion 522 to drive the drive blade 28.

The timeout mechanism 568 is operable to lock the trigger 530, and more specifically the trigger arm 538, from being actuated in response to inactivity (i.e., lack of actuation) of the contact arm 546 over a preset time interval that begins once the trigger 530 is initially depressed, as described in further detail below. The timeout mechanism 568 is disposed within the housing 518 and includes a rack gear 592, a mainspring 570 for driving the rack gear 592, a gas spring or counting assembly 576 to control the release of energy from the mainspring 570, and a lockout linkage 580 capable of interfacing with the distal end portion 538*b* of the trigger arm 538. The timeout mechanism 568 further includes a trigger linkage 584 coupled to the pivot shaft 534 of the trigger 530 and capable of interacting with the rack gear 592. The rack gear 592 selectively intermeshes with the rack 596 on the contact arm 546. The lockout linkage 580 has one end pivotably coupled to the rack gear 592 and an opposite free end capable of interfering with the distal end portion 538*b* of the trigger arm 538. A support wall 604 on the housing 518 is disposed adjacent the lockout linkage 580 and prevents the lockout linkage 580 from pivoting upward beyond the orientation shown in FIG. 7.

Figure 8:
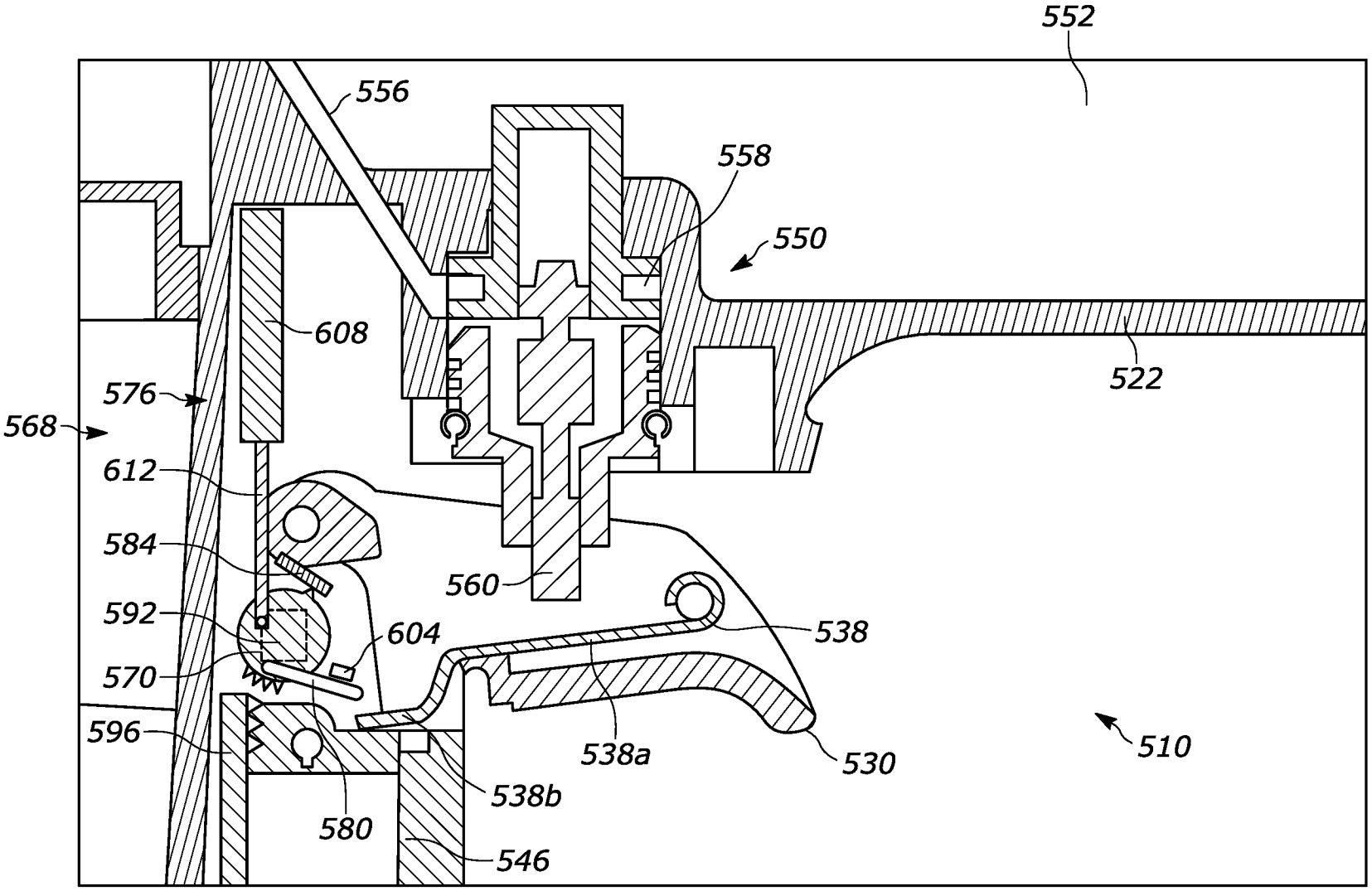
FIG. 8 is a cross-sectional view of a portion of the powered fastener driver of FIG. 7, illustrating the timeout mechanism in an unexpired state, the activation trigger in a depressed position, and the contact arm in the extended position.
Figure 9:
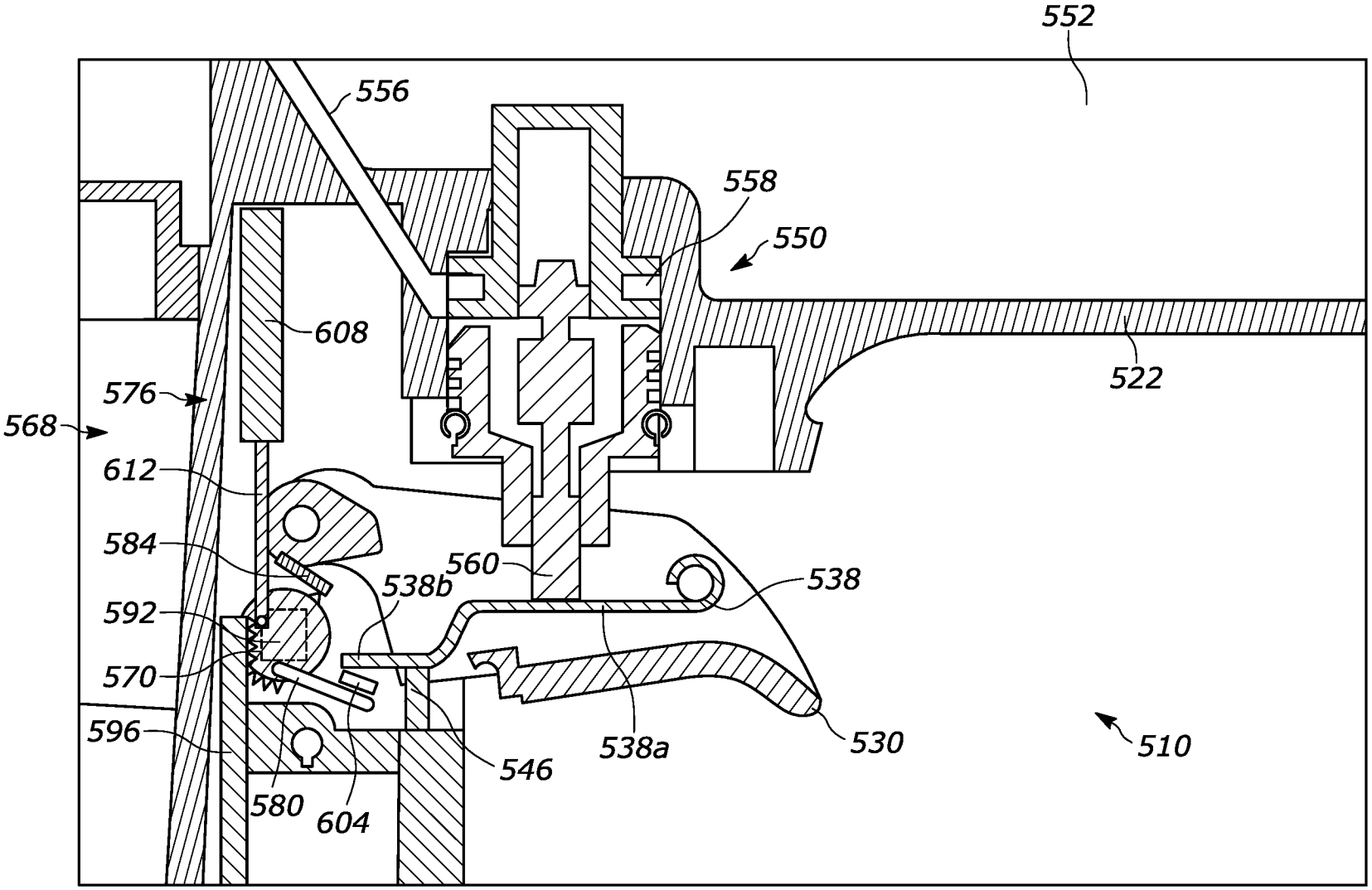
FIG. 9 is a cross-sectional view of a portion of the powered fastener driver of FIG. 7, illustrating the timeout mechanism in the unexpired state, the activation trigger in a depressed position, and the contact arm in a retracted position.

In operation, the fastener driver 510 is operable in two modes of operation—a first or single sequential mode (FIG. 11) and a second or bump-fire mode (FIGS. 7-10). While the fastener driver 510 is in bump-fire mode, the timeout mechanism 568 limits the amount of time an operator has to initiate a drive cycle (i.e., depress the contact arm 546 against a workpiece) after the trigger 530 is actuated to the depressed position. As illustrated in FIG. 7, the trigger linkage 584 is engaged with the rack gear 592 and the lockout linkage 580 is adjacent the distal end portion 538*b* of the trigger arm 538. At this point, the mainspring 570 is unwound, and thus the rack gear 592 is in an expired state. Also, the gas spring assembly 576 is in an extended position. By actuating the trigger 530 to the depressed position as illustrated in FIG. 8, the trigger linkage 584 co-rotates with the trigger 530 in a counter-clockwise direction, which ultimately winds the mainspring 570 and places the rack gear 592 in an unexpired state. Specifically, rotation of the trigger linkage 584 causes the following sequence of events to simultaneously occur: (a) rotation of the rack gear 592 in a clockwise direction; (b) separation of the lockout linkage 580 and the distal end portion 538*b* of the trigger arm 538 such that interference therebetween no longer exists; and (c) actuation of the gas spring assembly 576 towards a retracted position. The mainspring 570 and the rack gear 592 are fully wound, thereby starting the preset time interval during which the operator is permitted to initiate the drive cycle. In the event the operator depresses the contact arm 546 against a workpiece (i.e., initiates the drive cycle) as illustrated in FIG. 9, the contact arm 546 contacts the distal end portion 538*b* of the trigger arm 538, causing rotation of the trigger arm 538 towards the valve stem 560 at which point the central portion 538*a* of the trigger arm 538 actuates the valve stem 560. Subsequently, the drive mechanism 29 drives the drive blade 28 to discharge a fastener through the nosepiece 526 and into the workpiece. By doing so, the rack 596 of the contact arm 546 is displaced into mesh engagement with the rack gear 592 to again cause rotation of the rack gear 592 in the clockwise direction. This time, rotation of the rack gear 592 via the rack 596 re-actuates the gas spring assembly 576 to the retracted position, thereby resetting the timeout mechanism 568 since the mainspring 570 and the rack gear 592 are fully rewound again.

Figure 10:
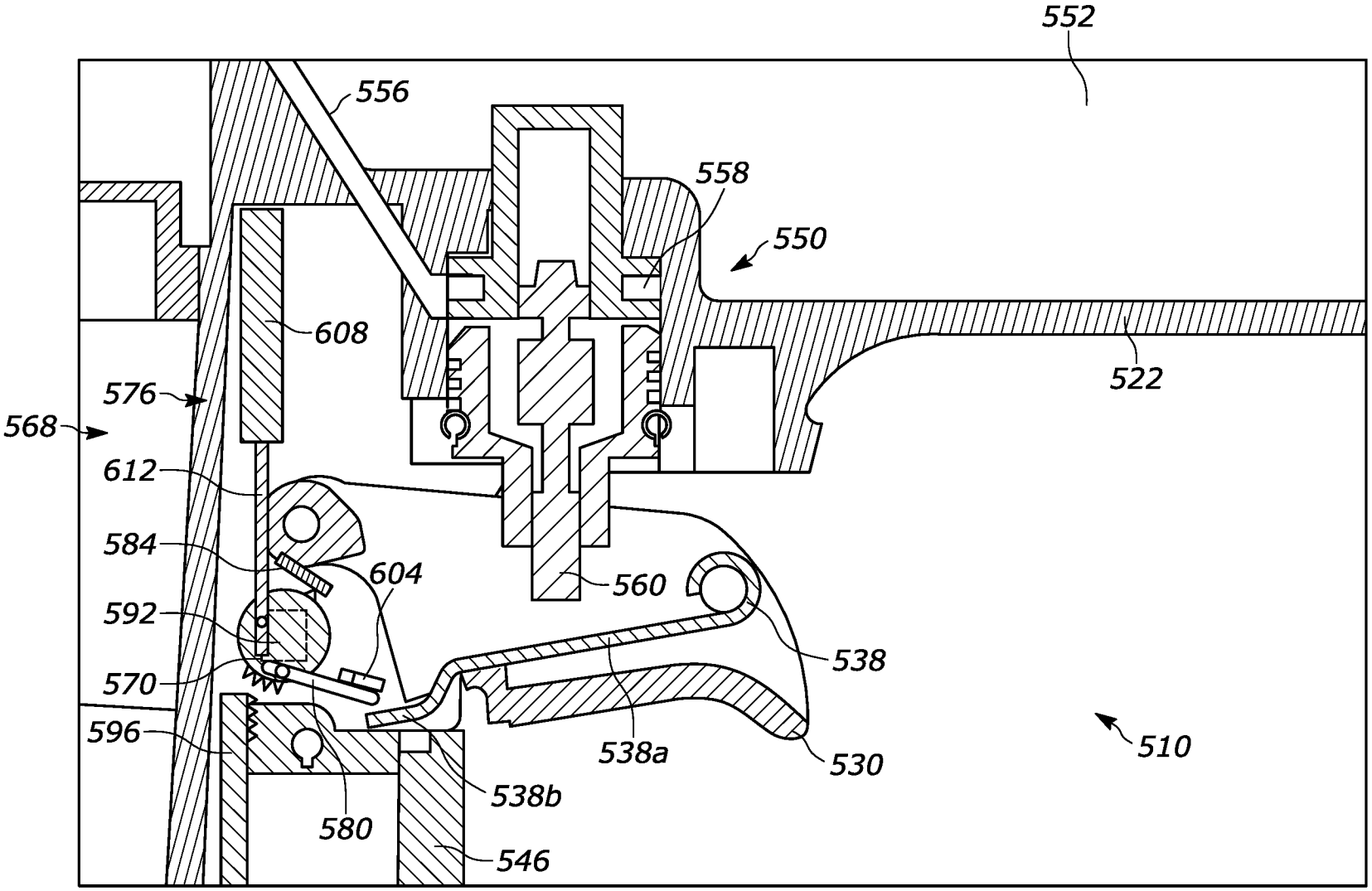
FIG. 10 is a cross-sectional view of a portion of the powered fastener driver of FIG. 7, illustrating the timeout mechanism in the expired state, the activation trigger in a depressed position, and the contact arm in the extended position.
Figure 11:
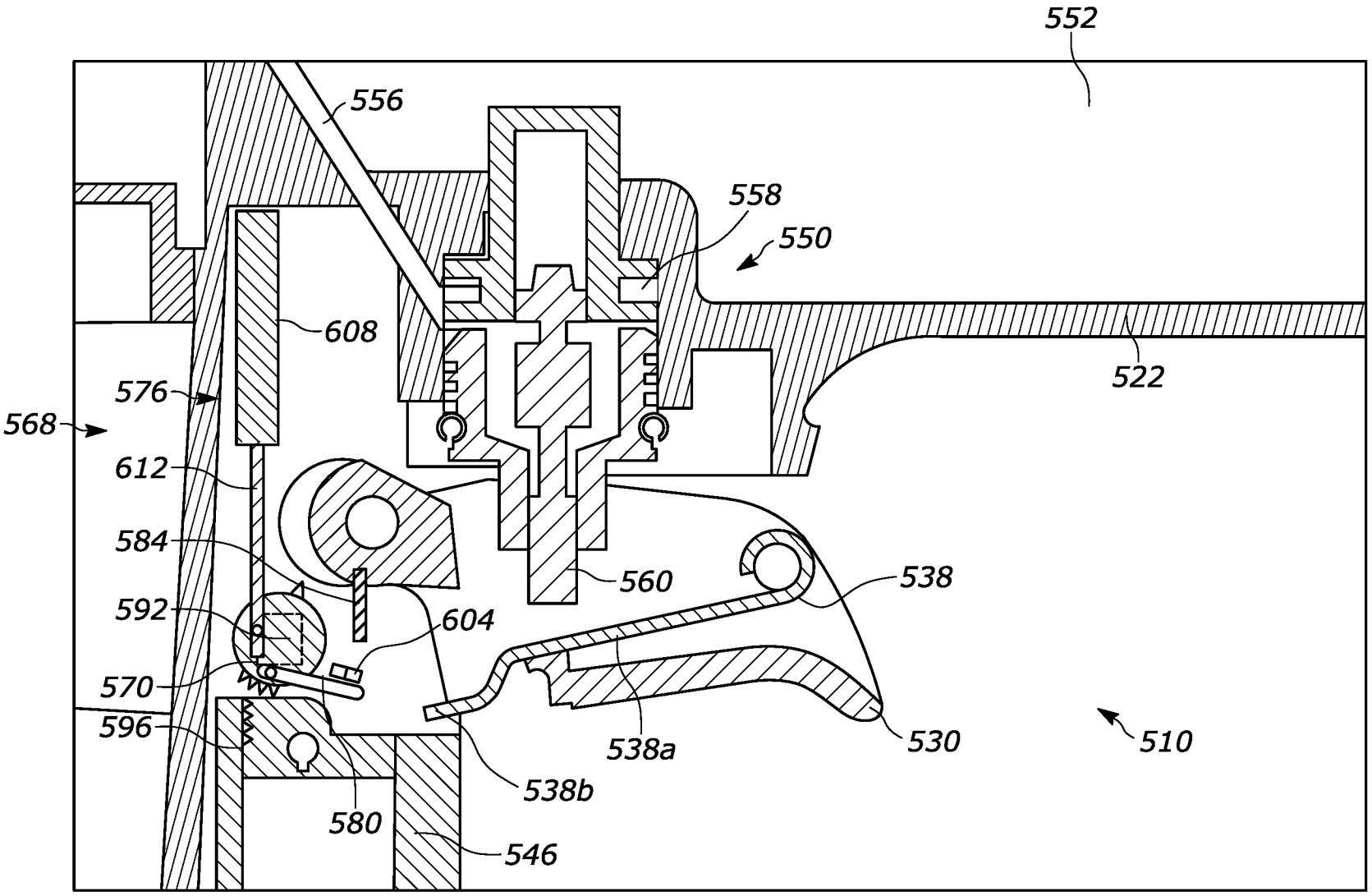
FIG. 11 is a cross-sectional view of a portion of the powered fastener driver of FIG. 7, illustrating the timeout mechanism disengaged from the activation trigger.

Now, in the event the operator fails to depresses the contact arm 546 against a workpiece (i.e., initiates the drive cycle) within the preset time interval, the lockout linkage 580, which itself is prevented from pivoting upward by the support wall 604, mechanically interferes with the distal end portion 538*b* of the trigger arm 538. As a result, the trigger arm 538 is no longer pivotable to actuate the valve stem 560, as illustrated in FIG. 10. The support wall 604 inhibits the contact arm 546 from pivoting both the lockout linkage 580 and the trigger arm 538 if an attempt is made to depress the contact arm 546 after expiration of the preset time interval. At the beginning of the preset time interval, the mainspring 570 and rack gear 592 are fully wound and the timeout mechanism 568 is thereby set in motion. The mainspring 570 and the rack gear 592 are slowly unwound over the preset time interval via the gas spring assembly 576. The gas spring assembly 576 includes a cylinder 608 and a piston rod 612 slidably disposed within the cylinder 608. The gas spring assembly 576 operates as a conventional gas spring assembly, such that the gas spring assembly 576 uses compressed gas contained within the enclosed cylinder 608 sealed by the sliding piston rod 612 to pneumatically store potential energy and withstand external force applied parallel to the direction of the piston rod 612. In other words, the gas spring assembly 576 is a viscous fluid damper that controls the unwinding (i.e., the energy release) of the mainspring 570 throughout the preset time interval. In the illustrated embodiment, the piston rod 612 is urged toward the retracted position as the rack gear 592 rotates in the clockwise direction. The piston rod 612 gradually moves toward the extended position since the piston rod 612 is biased toward the extended position. The movement of the piston rod 612 from the retracted position toward the extended position is gradual as the piston rod 612 moves slowly through the fluid (i.e., gas or liquid) contained within the cylinder 608. Subsequently, the piston rod 612 is in the fully extended position coinciding with the mainspring 570 being completely unwound and the rack gear 592 is in the expired state.

When the fastener driver 510 is in the sequential mode (FIG. 11), the timeout mechanism 568 is disengaged from the trigger 530 such that the operator is not required to initiate the drive cycle within the preset time interval defined by the timeout mechanism 568. By placing the fastener driver 510 in sequential mode, the trigger 530 is displaced relative to the handle portion 522 via the cammed surface of the knob 66. Accordingly, the trigger linkage 584 is also displaced relative to the rack gear 592 such that the trigger linkage 584 and the rack gear 592 are no longer in contact. Also, the lockout linkage 580 is no longer in proximity to interfere with the trigger arm 538 of the trigger 530. Thus, the timeout mechanism 568 is disabled when the fastener driver 510 is in the sequential mode. During operation of the fastener driver 10 in sequential mode, compressed air at high pressure is maintained within the air supply chamber 552 prior to the activation trigger 530 being actuated towards the depressed position. Air from the supply chamber 552 is guided into the trigger air chamber 558 and the main air passage 556. Once the contact arm 546 and the activation trigger 530 (and therefore the valve stem 560) are actuated to the depressed position, the trigger air chamber 558 opens to atmosphere as air exits the trigger valve assembly 550, allowing the head valve (not shown) to actuate and causing the compressed air from the air supply chamber 552 to actuate the drive mechanism 29 and the drive blade 28.

Figure 12:
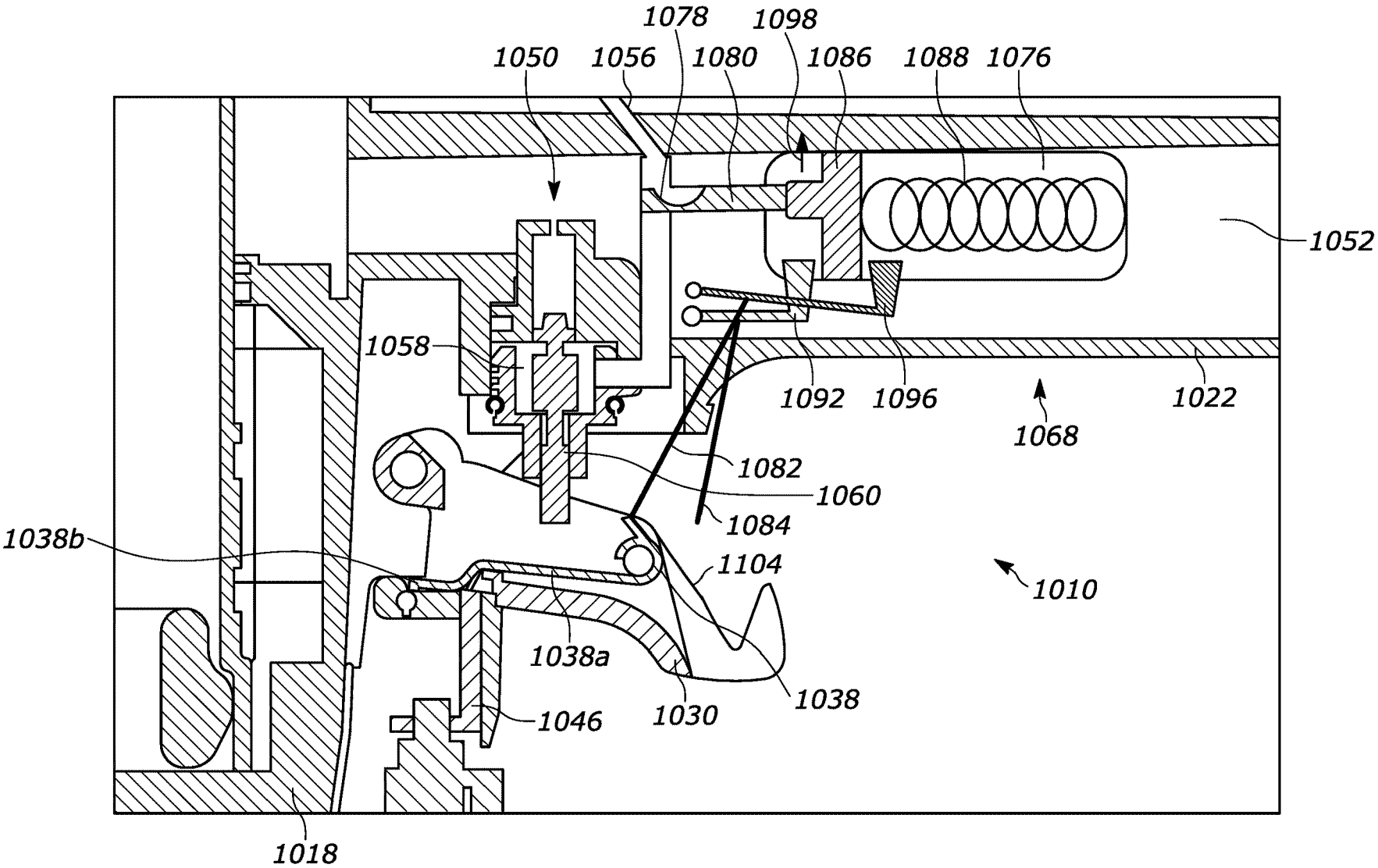
FIG. 12 is a cross-sectional view of a portion of a powered fastener driver in accordance with another embodiment along line 2-2 of FIG. 1, illustrating a timeout mechanism in an expired state, an activation trigger in a default position, and a contact arm in an extended position.

FIG. 12 illustrates a fastener driver 1010 in accordance with another embodiment of the invention. The fastener driver 1010 includes a timeout mechanism 1068 operable to inhibit a drive cycle, but is otherwise similar to the fastener driver 10 described above with reference to FIGS. 1-6, with like components being shown with like reference numerals plus 1000. Differences between the fastener drivers 10, 1010 are described below.

The fastener driver 1010 includes a housing 1018 with a handle portion 1022, an activation trigger 1030, a contact arm 1046, and a trigger valve assembly 1050. The activation trigger 1030 is disposed adjacent the handle portion 1022 and is user-actuated from a default position (FIG. 12) to a depressed position (FIG. 13) to initiate the drive cycle to begin each drive cycle. The contact arm 1046 is also movable between a biased, extended position (FIG. 14) in which fasteners are inhibited from being discharged from the magazine 14, and a retracted position (FIG. 15) in which fasteners are permitted to be discharged from the magazine 14. In the illustrated embodiment, the contact arm 1046 mechanically interfaces with the activation trigger 1030 to selectively permit a drive cycle to be initiated. The trigger valve assembly 1050 is disposed adjacent the activation trigger 1030. High air pressure is released to atmosphere (i.e., atmospheric pressure) through the trigger valve assembly 1050 via the valve stem 1060 when the activation trigger 1030 is actuated, causing the head valve (not shown) to actuate and allowing compressed air stored in the handle portion 1022 to drive the drive blade 28.

Figure 13:
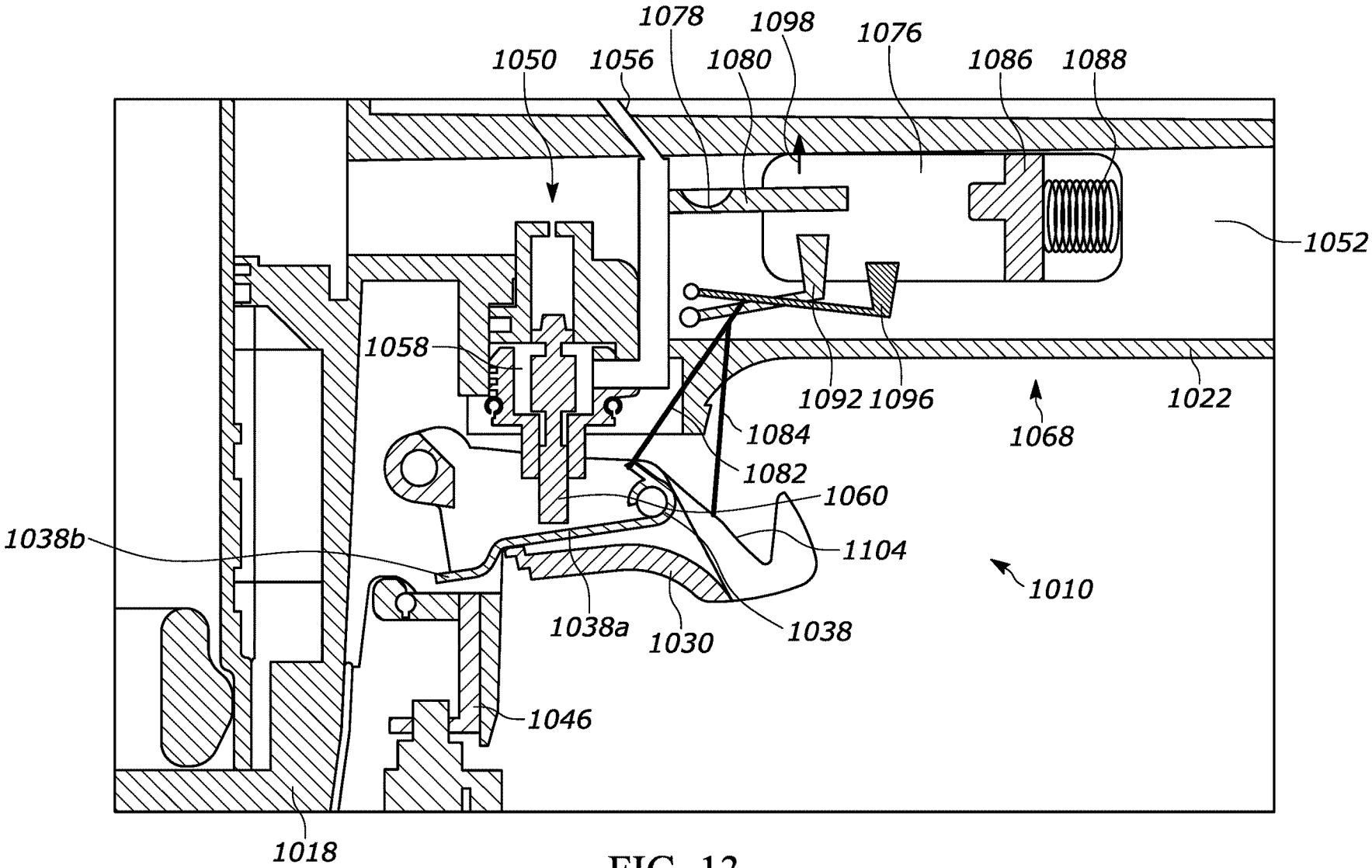
FIG. 13 is a cross-sectional view of a portion of the powered fastener driver of FIG. 12, illustrating the timeout mechanism in an unexpired state, the activation trigger in a depressed position, and the contact arm in the extended position.

In this particular embodiment, the timeout mechanism 1068 is operable to inhibit high air pressure from releasing to atmosphere by blocking the main air passage 1056, thereby effectively disabling the valve stem 1060 in response to inactivity (i.e., lack of actuation) of the contact arm 1046 over a preset time interval that begins once the trigger 1030 is initially depressed, as described in further detail below. The timeout mechanism 1068 is disposed within the handle portion 1022 and includes a timeout air chamber or counting assembly 1076, an air-lock pin 1080, a sled 1086 moveable between a retracted position and an extended position within the timeout air chamber 1076, and a spring 1088 biasing the sled 1086 toward the extended position. The air-lock pin 1080 is moveable between a first or "blocking" position (as shown in FIG. 12) corresponding to the sled 1086 being in the extended position and a second "unblocking" position (as shown in FIG. 13) corresponding to the sled 1086 being in the retracted position. In the blocking position, the air-lock pin 1080 substantially blocks airflow from escaping through the main air passage 1056, whereas airflow is allowed to escape through the main air passage 1056 when the air-lock pin 1080 is in the unblocking position. The air-lock pin 1080 is pushed into the blocking position when contacted by the sled 1086 returning to the extended position shown in FIG. 12. Likewise, when the pin 1080 is released by the sled 1086, compressed air in the main air passage 1056 pushes the pin 1080 from the blocking position (FIG. 12) to the unblocking position (FIG. 13) as a result of compressed air flooding the scallop 1078 in the pin 1080 and exerting an axial biasing force on the pin 1080 toward the unblocking position.

The timeout mechanism 1068 further includes a first control valve 1092, a second control valve 1096, a trigger linkage 1084 coupled between the trigger 1030 and the first control valve 1092, and a trigger arm linkage 1082 coupled between the trigger arm 1038 and the second control valve 1096. The first and second control valves 1092, 1096 are in fluid communication with the timeout air chamber 1076 and are capable of selectively introducing pressurized air therein.

In operation, the fastener driver 1010 is operable in two modes of operation—a first or single sequential mode (FIG. 18-21) and a second or bump-fire mode (FIGS. 12-17). While the fastener driver 1010 is in bump-fire mode, the timeout mechanism 1068 limits the amount of time an operator has to initiate a drive cycle (i.e., depress the contact arm 1046 against a workpiece) after the trigger 1030 is actuated to the depressed position. As illustrated in FIG. 12, the preset time interval of bump-fire mode has not started since the trigger 1030 is in the default position and the contact arm 1046 is in the extended position. Once the trigger 1030 is actuated towards the depressed position (FIG. 13), pressurized air is introduced into the timeout air chamber 1076 in response to the first control valve 1092 opening (via a force exerted by the trigger linkage 1084), thereby actuating the sled 1086 to the retracted position. With the sled 1086 in the retracted position, the air-lock pin 1080 is urged towards the unblocking position when pressurized air within the main air passage 1056 floods the scallop 1078. At this point, the fastener driver 1010 is ready to initiate a drive cycle upon actuation of the contact arm 1046. In other words, the preset time interval has started during which the operator is permitted to initiate the drive cycle.

Figure 14:
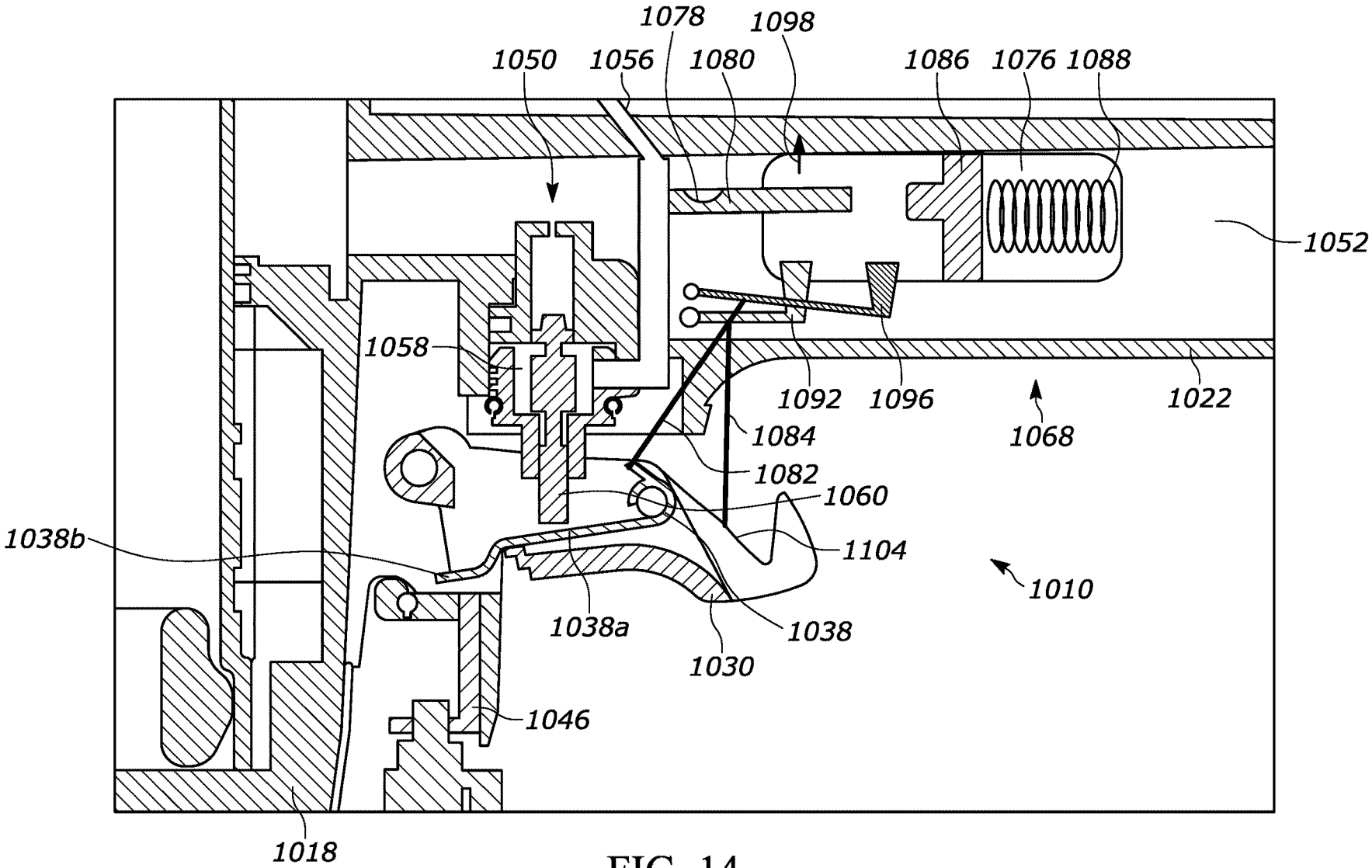
FIG. 14 is a cross-sectional view of a portion of the powered fastener driver of FIG. 12, illustrating the timeout mechanism in the unexpired state, the activation trigger in a depressed position, and the contact arm in the extended position.
Figure 15:
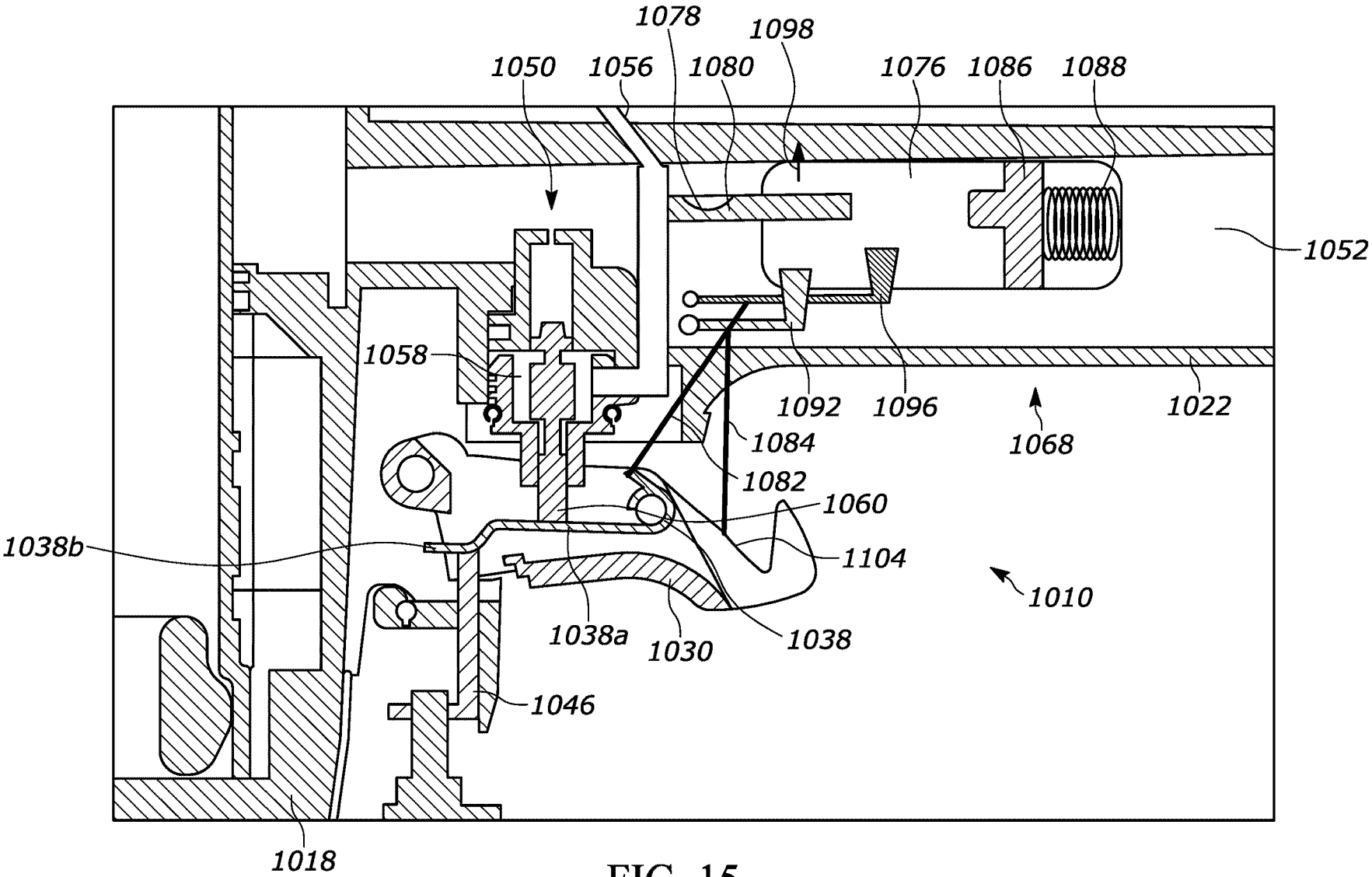
FIG. 15 is a cross-sectional view of a portion of the powered fastener driver of FIG. 12, illustrating the timeout mechanism in the unexpired state, the activation trigger in a depressed position, and the contact arm in a retracted position.

As illustrated in FIG. 14, the trigger linkage 1084 disengages a detent 1104 disposed on the trigger 1030 as the trigger 1030 approaches the fully depressed position, which causes the first control valve 1092 to slowly close and the timeout air chamber 1076 slowly loses pressure through the orifice 1098 over the preset time interval. As such, the spring 1088 gradually overcomes the pressure within the timeout air chamber 1076 and biases the sled 1086 toward the extended position. In the event the operator depresses the contact arm 1046 against a workpiece (i.e., initiates the drive cycle) as illustrated in FIG. 15, the contact arm 1046 contacts the distal end portion 1038*b* of the trigger arm 1038, causing rotation of the trigger arm 1038 towards the valve stem 1060 at which point the central portion 1038*a* of the trigger arm 1038 actuates the valve stem 1060. Since the main air passage 1056 is not blocked by the air-lock pin 1080, the fastener driver 1010 initiates the drive cycle. The drive mechanism 29 drives the drive blade 28 to discharge a fastener through the nosepiece 1026 and into the workpiece. By doing so, the trigger arm linkage 1082 coupled to the trigger arm 1038 is displaced to open the second control valve 1096 to again introduce pressurized air into the timeout air chamber 1076. The sled 1086 is re-actuated toward the retracted position, thereby resetting the timeout mechanism 1068 since the sled 1086 is fully retracted and the air-lock pin 1080 is not blocking the main air passage 1056.

Figure 16:
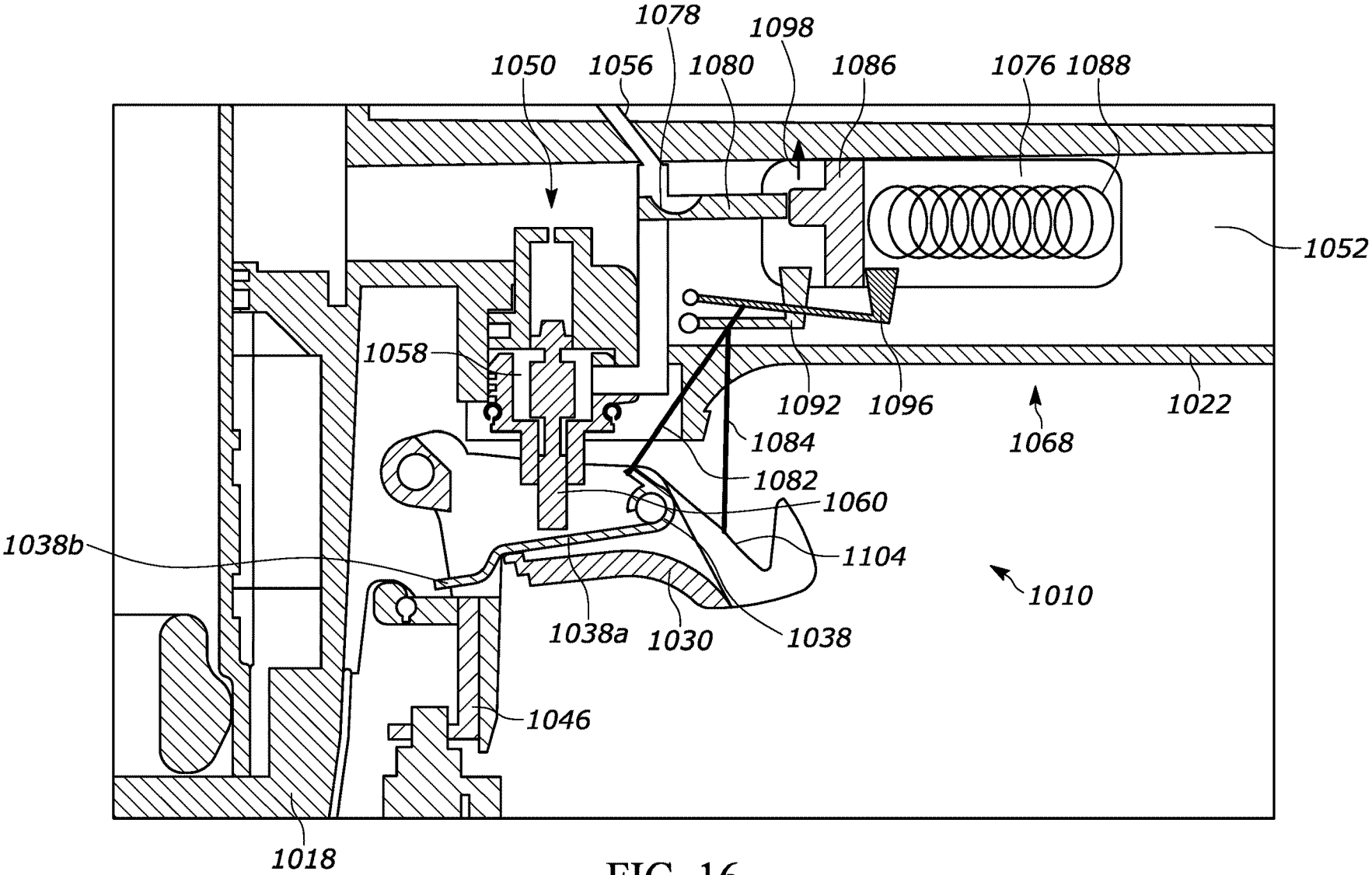
FIG. 16 is a cross-sectional view of a portion of the powered fastener driver of FIG. 12, illustrating the timeout mechanism in the expired state, the activation trigger in a depressed position, and the contact arm in the extended position.
Figure 17:
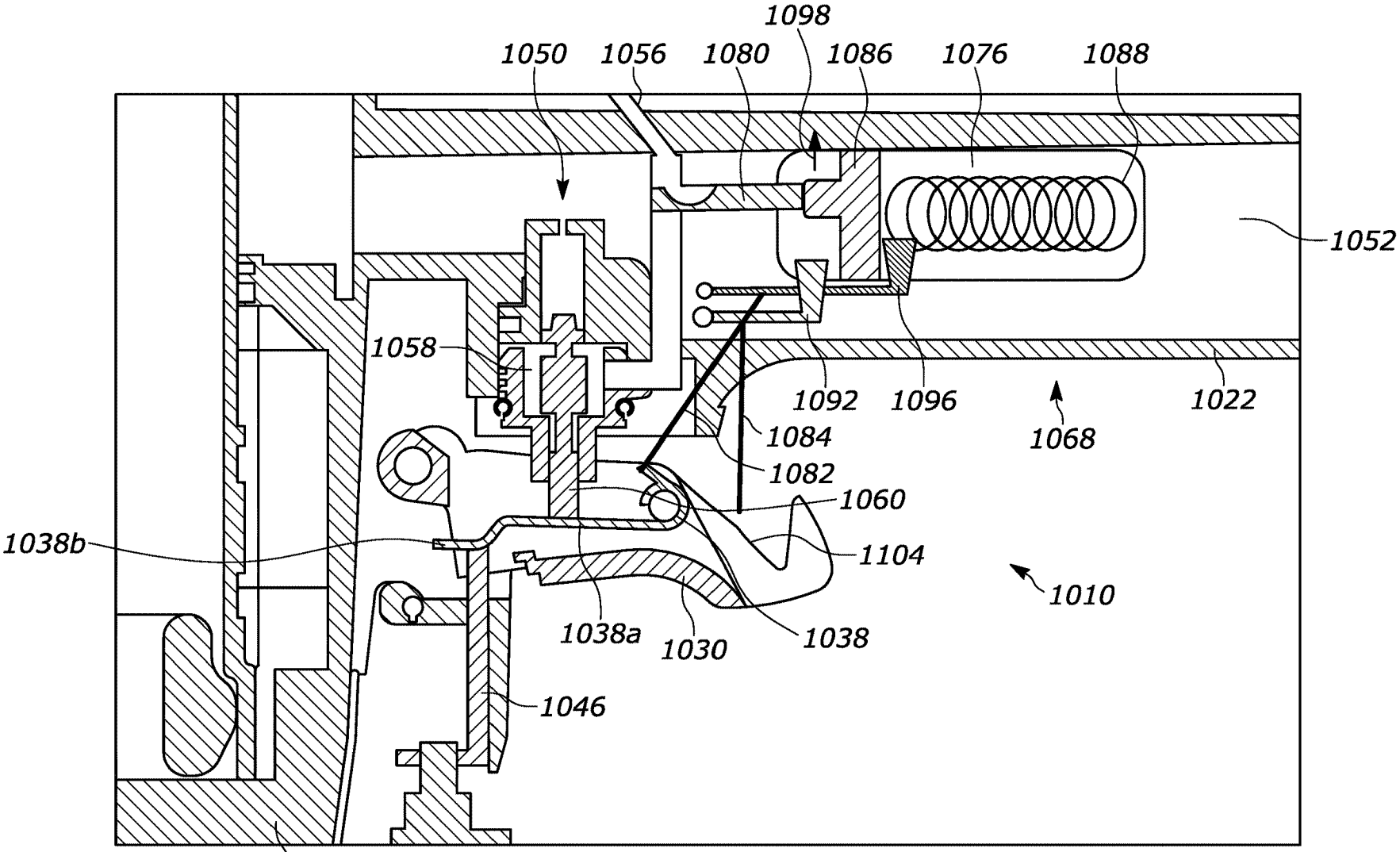
FIG. 17 is a cross-sectional view of a portion of the powered fastener driver of FIG. 12, illustrating the timeout mechanism in the expired state, the activation trigger in a depressed position, and the contact arm in the retracted position.
Figure 18:
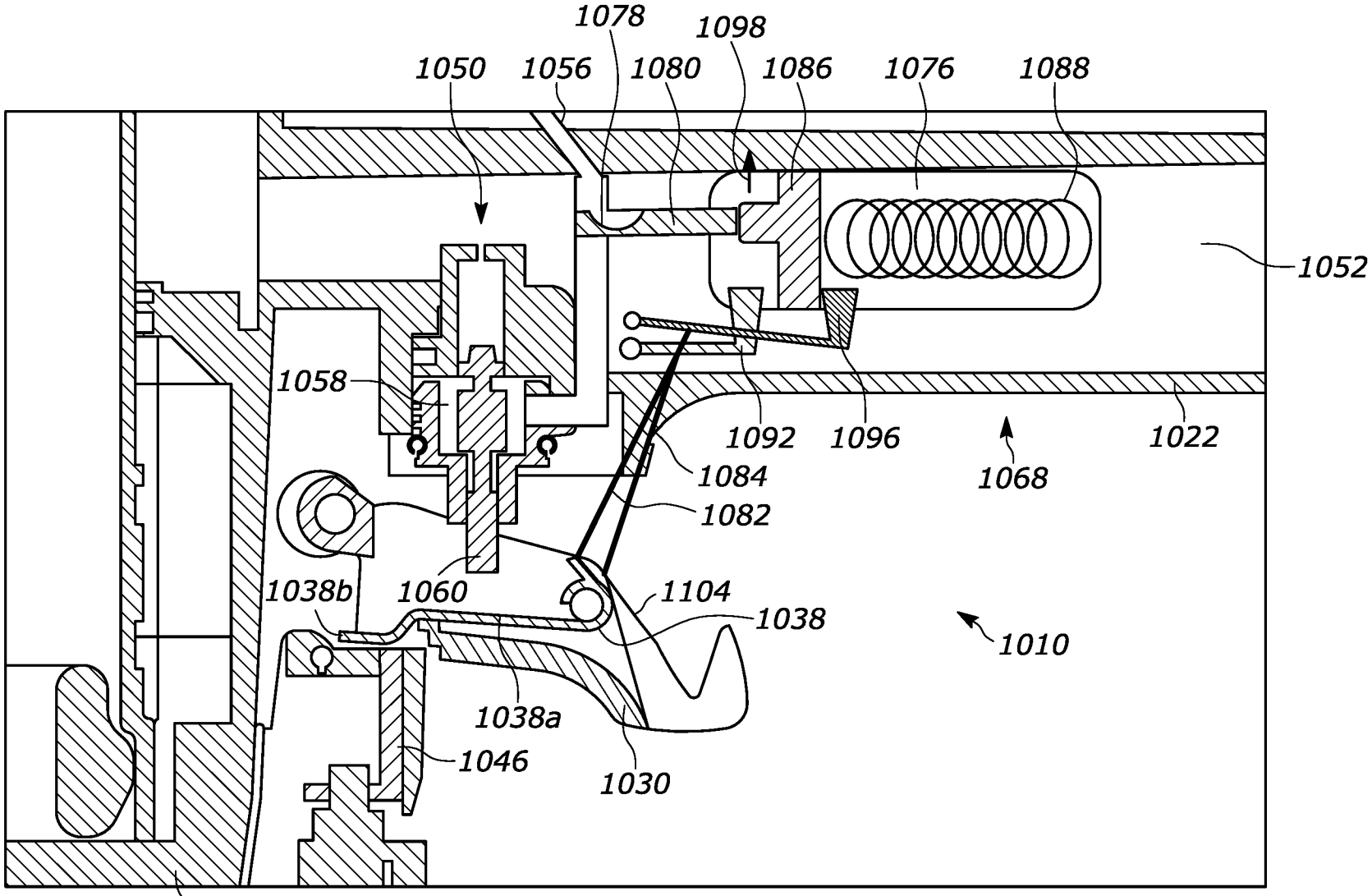
FIG. 18 is a cross-sectional view of a portion of the powered fastener driver of FIG. 12, illustrating the timeout mechanism disengaged from the activation trigger, the activation trigger in the default position, and the contact arm in the extended position.
Figure 19:
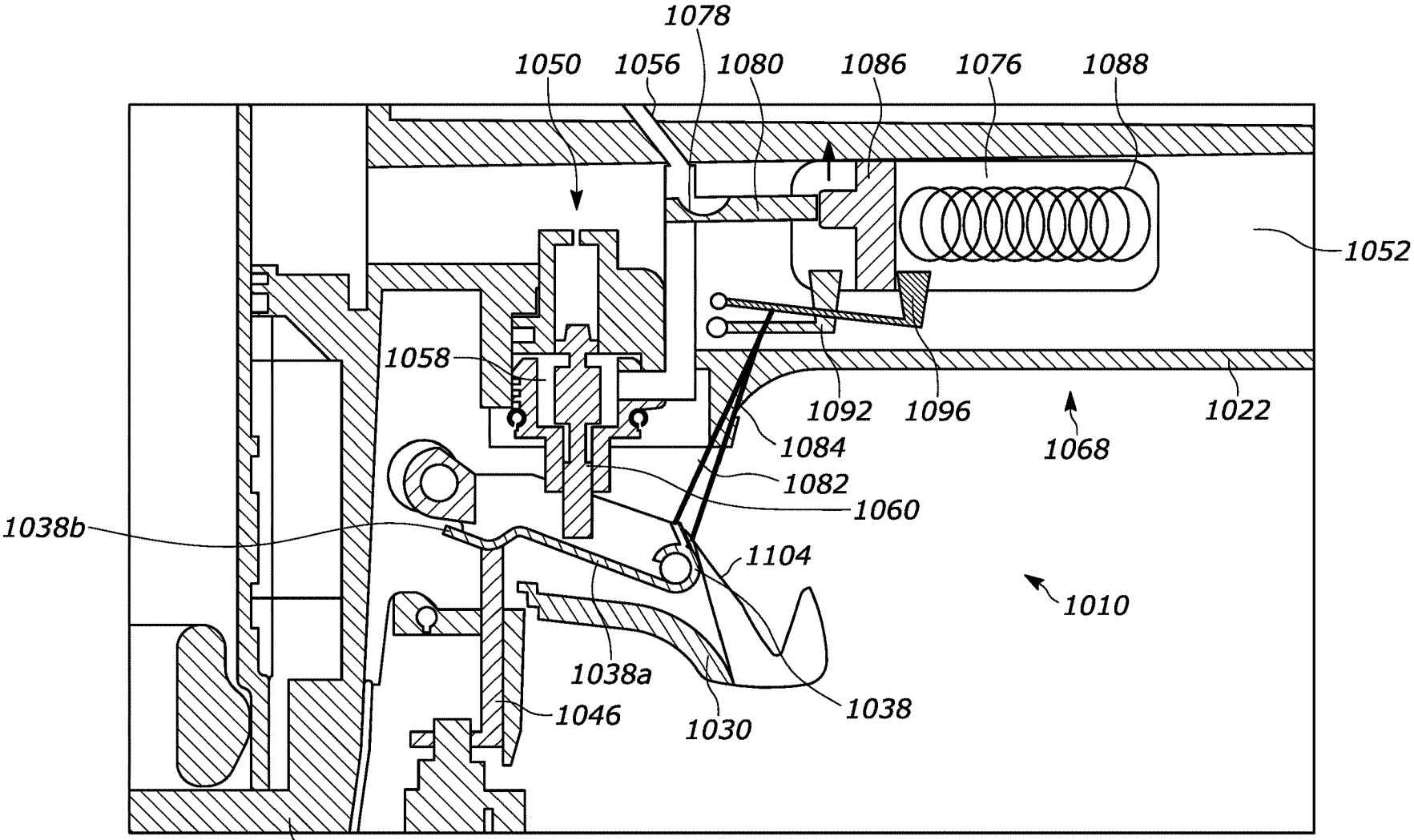
FIG. 19 is a cross-sectional view of a portion of the powered fastener driver of FIG. 12, illustrating the timeout mechanism disengaged from the activation trigger, the activation trigger in the default position, and the contact arm in the retracted position.
Figure 20:
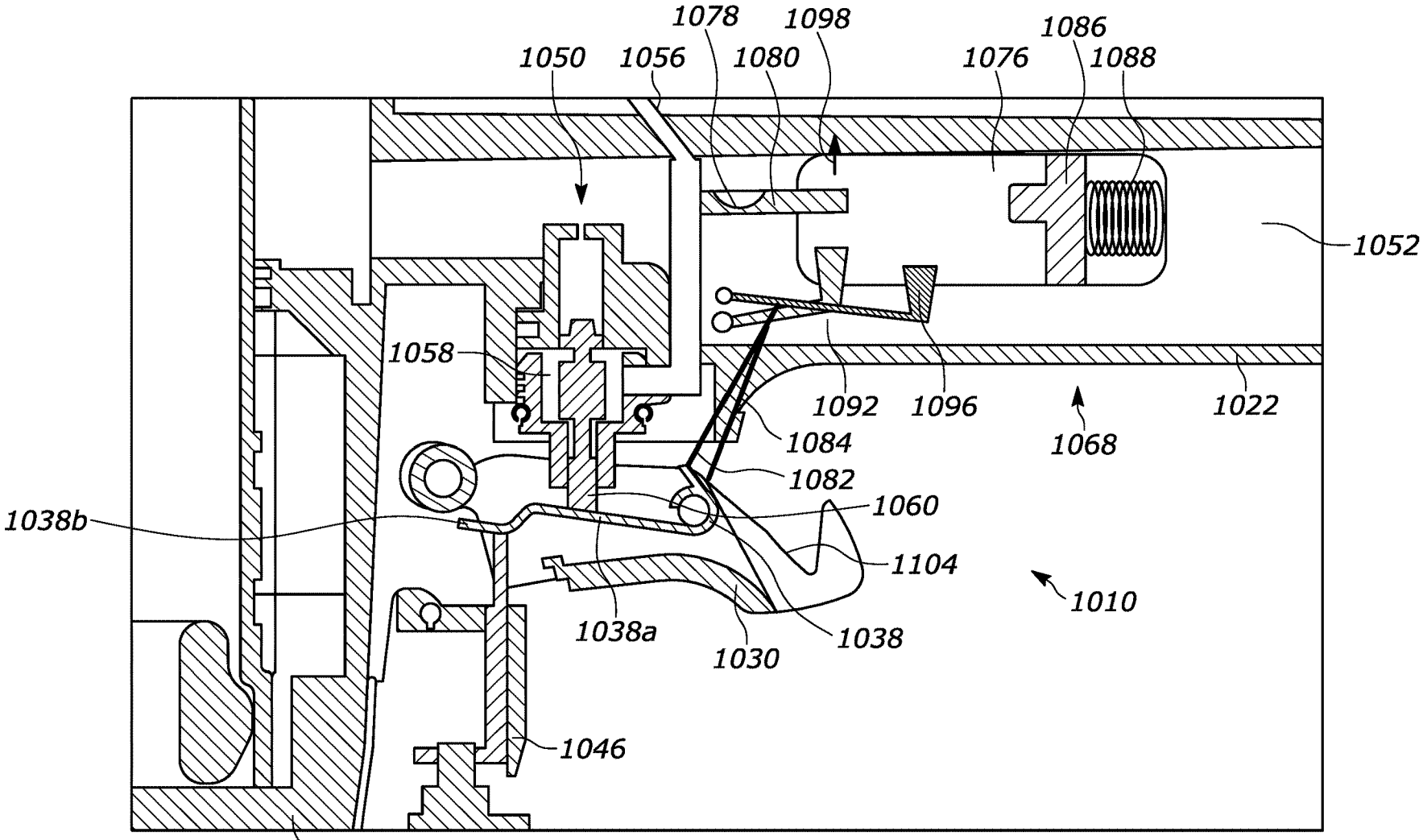
FIG. 20 is a cross-sectional view of a portion of the powered fastener driver of FIG. 12, illustrating the timeout mechanism disengaged from the activation trigger, the activation trigger in the depressed position, and the contact arm in the retracted position.

Now, in the event the operator fails to depress the contact arm 1046 against a workpiece (i.e., initiates the drive cycle) within the preset time interval, the air-lock pin 1080 mechanically blocks the main air passage 1056 at which point the valve stem 1060 is no longer able to release pressurized air to atmosphere, as illustrated in FIG. 16. Specifically, inactivity of the contact arm 1046 after depressing the trigger 1030 causes the following sequence of events to simultaneously occur: (a) leakage of pressurized air from the timeout air chamber 1076 through the orifice 1098; (b) actuation of the sled 1086 toward the extended position via the spring 1088; and (c) actuation of the air-lock pin 1080 to the blocking position in response to the sled 1086 being in the extended position. At this point, if the contact arm 1046 is depressed, pressurized air is introduced into the timeout air chamber 1076 behind the sled 1086 thus further biasing the sled 1086 to the extended position, as illustrated in FIG. 17. Thus, the drive cycle is inhibited from being initiated due to the air-lock pin 1080 being maintained in the blocking position even if the contact arm 1046 is depressed against a workpiece.

When the fastener driver 1010 is in the sequential mode (FIGS. 18-21), the second control valve 1096 of the timeout mechanism 1068 is effectively disengaged such that the operator is not required to initiate the drive cycle within the preset time interval defined by the timeout mechanism 1068. By placing the fastener driver 1010 in sequential mode, the trigger 1030 is displaced relative to the handle portion 1022 via the cammed surface of the knob 66. Accordingly, the trigger arm linkage 1082 is also displaced relative to the second control valve 1096 such that actuation of the contact arm 1046 (and therefore the trigger arm linkage 1082) does not open the second control valve 1096. Thus, during operation of sequential mode, the contact arm 1046 is first actuated to the depressed position to place the central portion 1038*a* of the trigger arm 1038 in contact with the valve stem 1060. When an operator actuates the trigger 1030 to the depressed position, the first control valve 1092 opens (via the trigger linkage 1084) and pressurized air is introduced into the timeout air chamber 1076. As a result, the air-lock pin 1080 is urged to the unblocking position (FIG. 20) as a result of compressed air flooding the scallop 1078 in the pin 1080 and exerting an axial biasing force on the pin 1080 toward the unblocking position. Further, air from the supply chamber 1052 is guided into the trigger air chamber 1058 and the main air passage 1056. The trigger air chamber 1058 opens to atmosphere as air exits the trigger valve assembly 1050, allowing the head valve (not shown) to actuate and causing the compressed air from the air supply chamber 1052 to actuate the drive mechanism 29 and the drive blade 28.

Figure 21:
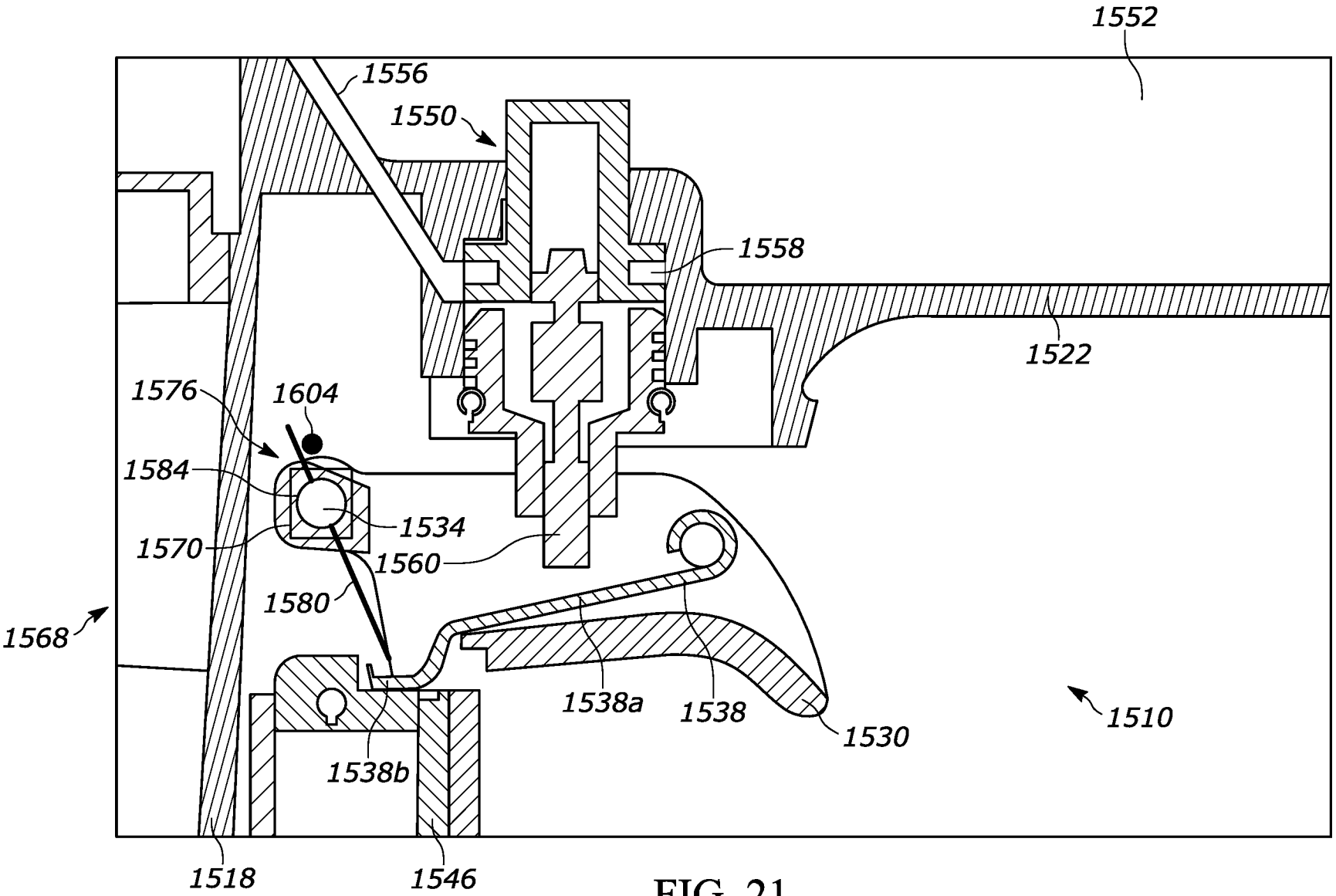
FIG. 21 is a cross-sectional view of a portion of a powered fastener driver in accordance with another embodiment along line 2-2 of FIG. 1, illustrating a timeout mechanism in an expired state, an activation trigger in a default position, and a contact arm in an extended position.

FIG. 21 illustrates a fastener driver 1510 in accordance with another embodiment of the invention. The fastener driver 1510 includes a timeout mechanism 1568 operable to inhibit a drive cycle, but is otherwise similar to the fastener driver 10 described above with reference to FIGS. 1-6, with like components being shown with like reference numerals plus 1500. Differences between the fastener drivers 10, 1510 are described below.

The fastener driver 1510 includes a housing 1518 with a handle portion 1522, an activation trigger 1530, a contact arm 1546, and a trigger valve assembly 1550. The activation trigger 1530 is disposed adjacent the handle portion 1522 and is user-actuated from a default position (FIG. 21) to a depressed position (FIG. 22) to initiate the drive cycle to begin each drive cycle. The contact arm 1546 is also movable between a biased, extended position (FIG. 21) in which fasteners are inhibited from being discharged from the magazine 14, and a retracted position (FIG. 23) in which fasteners are permitted to be discharged from the magazine 14. In the illustrated embodiment, the contact arm 1546 mechanically interfaces with the activation trigger 1530 to selectively permit a drive cycle to be initiated. The trigger valve assembly 1550 is disposed adjacent the activation trigger 1530. High air pressure is released to atmosphere (i.e., atmospheric pressure) through the trigger valve assembly 1550 via the valve stem 1560 when the activation trigger 1530 is actuated, causing the head valve (not shown) to actuate and allowing compressed air stored in the handle portion 1522 to drive the drive blade 28.

The timeout mechanism 1568 is operable to lock the trigger 1530, and more specifically the trigger arm 1538, from being actuated in response to inactivity (i.e., lack of actuation) of the contact arm 1546 over a preset time interval that begins once the trigger 1530 is initially depressed, as described in further detail below. The timeout mechanism 1568 is disposed within the housing 1518 and includes a mainspring 1570 for driving the timeout mechanism 1568, a counting assembly 1576 to control the release of energy from the mainspring 1570, and a lockout linkage 1580 capable of interfacing with the distal end portion 1538*b* of the trigger arm 1538. The lockout linkage 1580 is secured to a female barrel 1586 which, in turn, is pivotably coupled around the pivot shaft 1534 of the trigger 1530. The lockout linkage 1580 rotates with the female barrel 1586 relative to the pivot shaft 1534. The mainspring 1570 urges the lockout linkage 1580 towards the expired state (as shown in FIG. 21), where the lockout linkage 1580 abuts a support wall 1604 of the housing 1518 to prevent the lockout linkage 1580 from pivoting beyond the orientation shown in FIG. 21. The counting assembly 1576 further includes a damping grease (e.g., NyoGel® 767A, 774, 774L, lithium grease, etc.) disposed between the pivot shaft 1534 and the female barrel 1586 to effectively control the angular rate (i.e., angular velocity) at which the female barrel 1586 rotates about the pivot shaft 1534. Specifically, the damping grease slows down the angular rate at which the female barrel 1586 rotates about the pivot shaft 1534. The damping grease is operable to slow down the angular rate of rotation between the female barrel 1586 and the pivot shaft 1534 due to its positive viscous properties, thereby creating friction (i.e., opposing relative motion) between the surfaces of the barrel 1584 and the shaft 1534.

Figure 22:
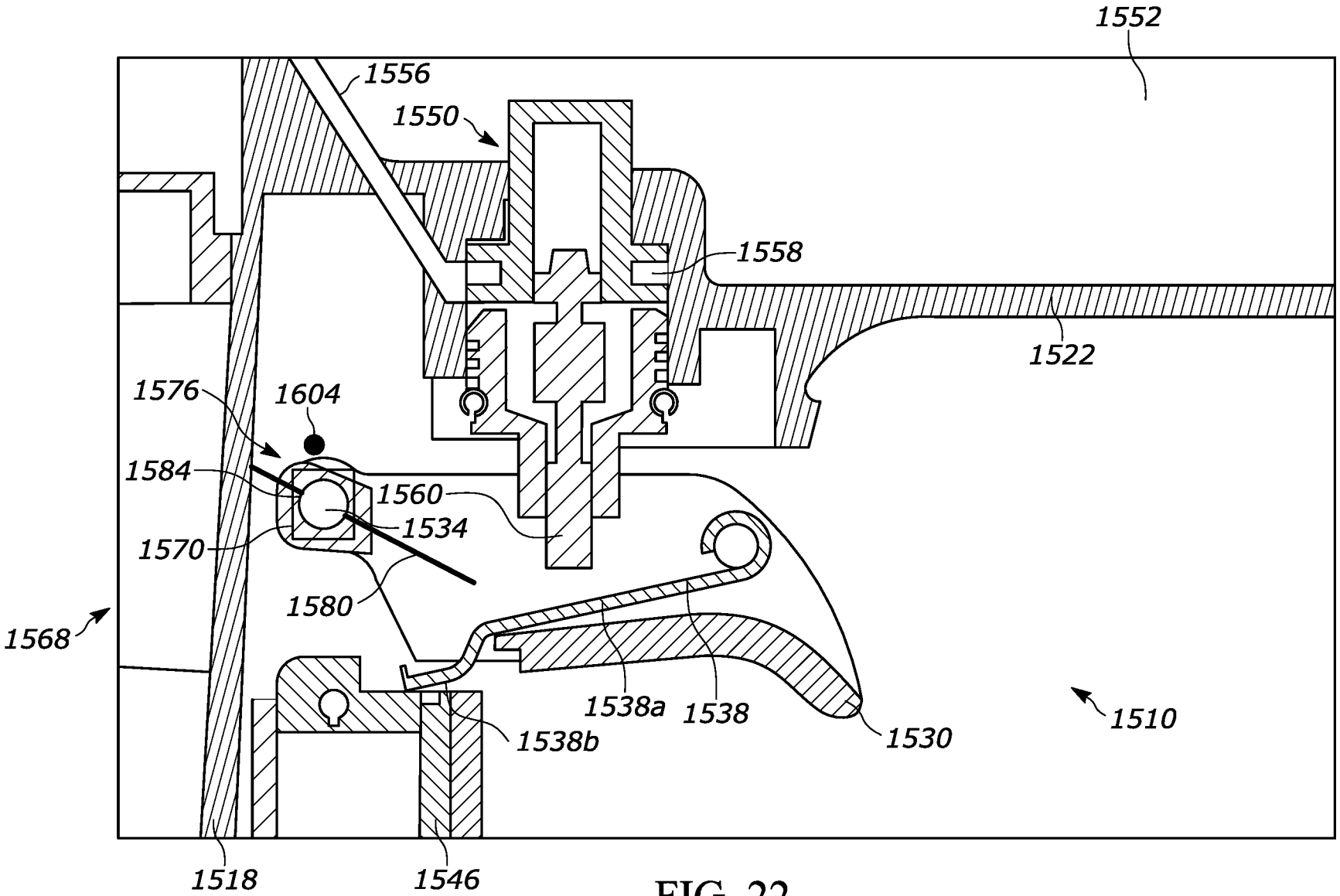
FIG. 22 is a cross-sectional view of a portion of the powered fastener driver of FIG. 21, illustrating the timeout mechanism in an unexpired state, the activation trigger in a depressed position, and the contact arm in the extended position.

In operation, the fastener driver 1510 is operable in two modes of operation—a first or single sequential mode (FIG. 25) and a second or bump-fire mode (FIGS. 21-24). While the fastener driver 1510 is in bump-fire mode, the timeout mechanism 1568 limits the amount of time an operator has to initiate a drive cycle (i.e., depress the contact arm 1546 against a workpiece) after the trigger 1530 is actuated to the depressed position. As illustrated in FIG. 21, the trigger 1530 is in the default position and the lockout linkage 1580 is adjacent the distal end portion 1538*b* of the trigger arm 1538. At this point, the mainspring 1570 is unwound, and thus the counting assembly 1576 is in the expired state. By actuating the trigger 1530 to the depressed position as illustrated in FIG. 22, the lockout linkage 1580 (and therefore the female barrel 1586) is rotated in a counter-clockwise direction away from the distal end portion 1538*b* of the trigger arm 1538, which ultimately winds the mainspring 1570 and places the counting assembly 1576 in an unexpired state. In some instances, a mechanical advantage (e.g., gearing, camming, linkage, etc.) is provided to assist the lockout linkage 1580 in rotating through an angular range of motion that is twice as large as the angular rotation of the trigger 1530 in order to set the counting assembly 1576. In other embodiments, a secondary trigger (e.g., thumb trigger, external wheel, or the like) may alternatively be provided to set the counting assembly 1576 so that setting the counting assembly 1576 is a separate action from actuation of the trigger 1530.

Figure 23:
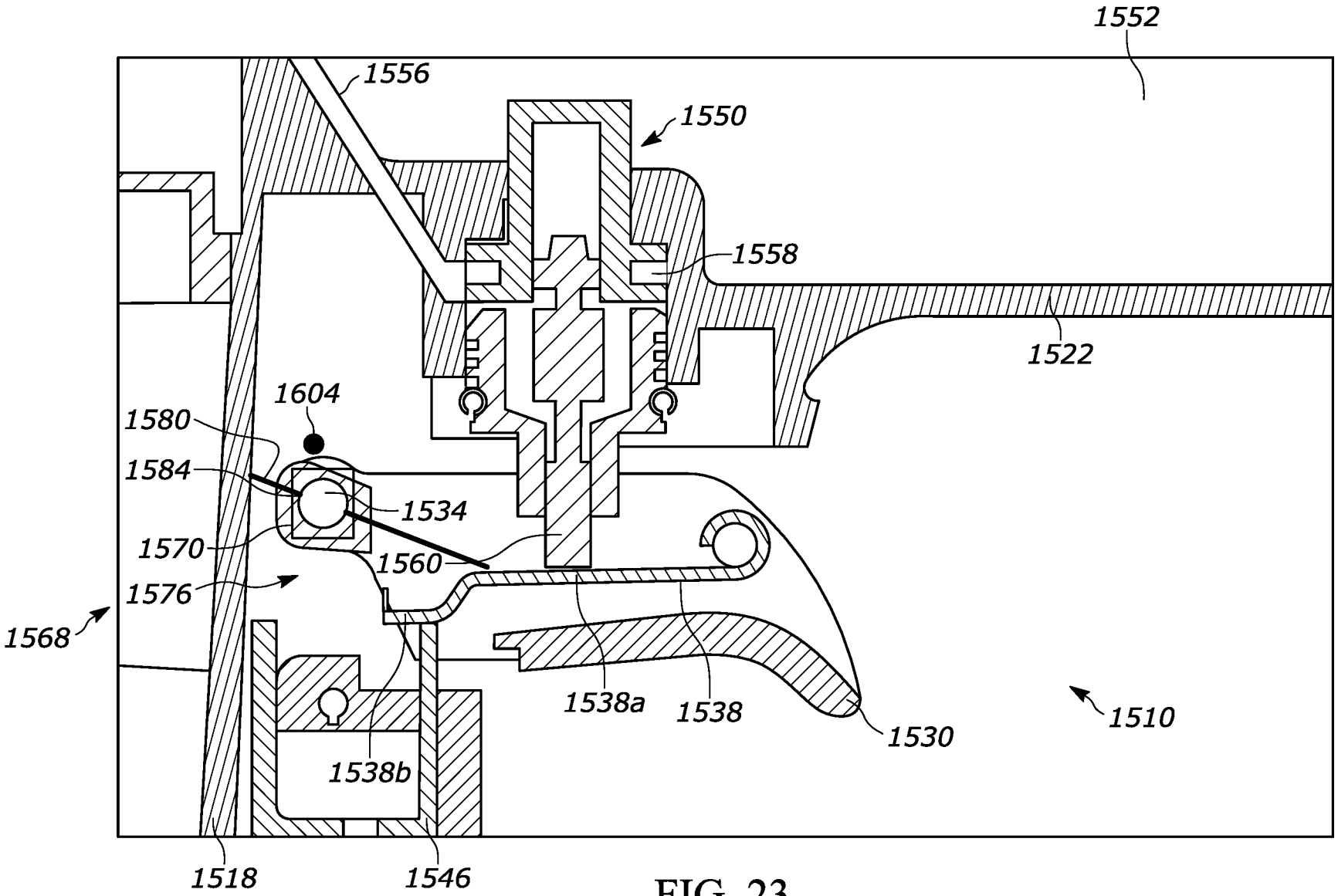
FIG. 23 is a cross-sectional view of a portion of the powered fastener driver of FIG. 21, illustrating the timeout mechanism in the unexpired state, the activation trigger in a depressed position, and the contact arm in the retracted position.

At this point, the mainspring 1570 and the lockout linkage 1580 are fully wound, thereby starting the preset time interval during which the operator is permitted to initiate the drive cycle. In the event the operator depresses the contact arm 1546 against a workpiece (i.e., initiates the drive cycle) as illustrated in FIG. 23, the contact arm 1546 contacts the distal end portion 1538*b* of the trigger arm 1538, causing rotation of the trigger arm 1538 towards the valve stem 1560 at which point the central portion 1538*a* of the trigger arm 1538 actuates the valve stem 1560. Subsequently, the drive mechanism 29 drives the drive blade 28 to discharge a fastener through the nosepiece 1526 and into the workpiece. When the contact arm 1546 contacts the distal end portion 1538*b*, the contact arm 1538 simultaneously pushes the distal end portion 1538*b* into contact with the lockout linkage 1580 to rotate the linkage 1580 in the counter-clockwise direction back towards the unexpired state, thereby resetting the timeout mechanism 1568 since the mainspring 1570 is fully wound again.

Figure 24:
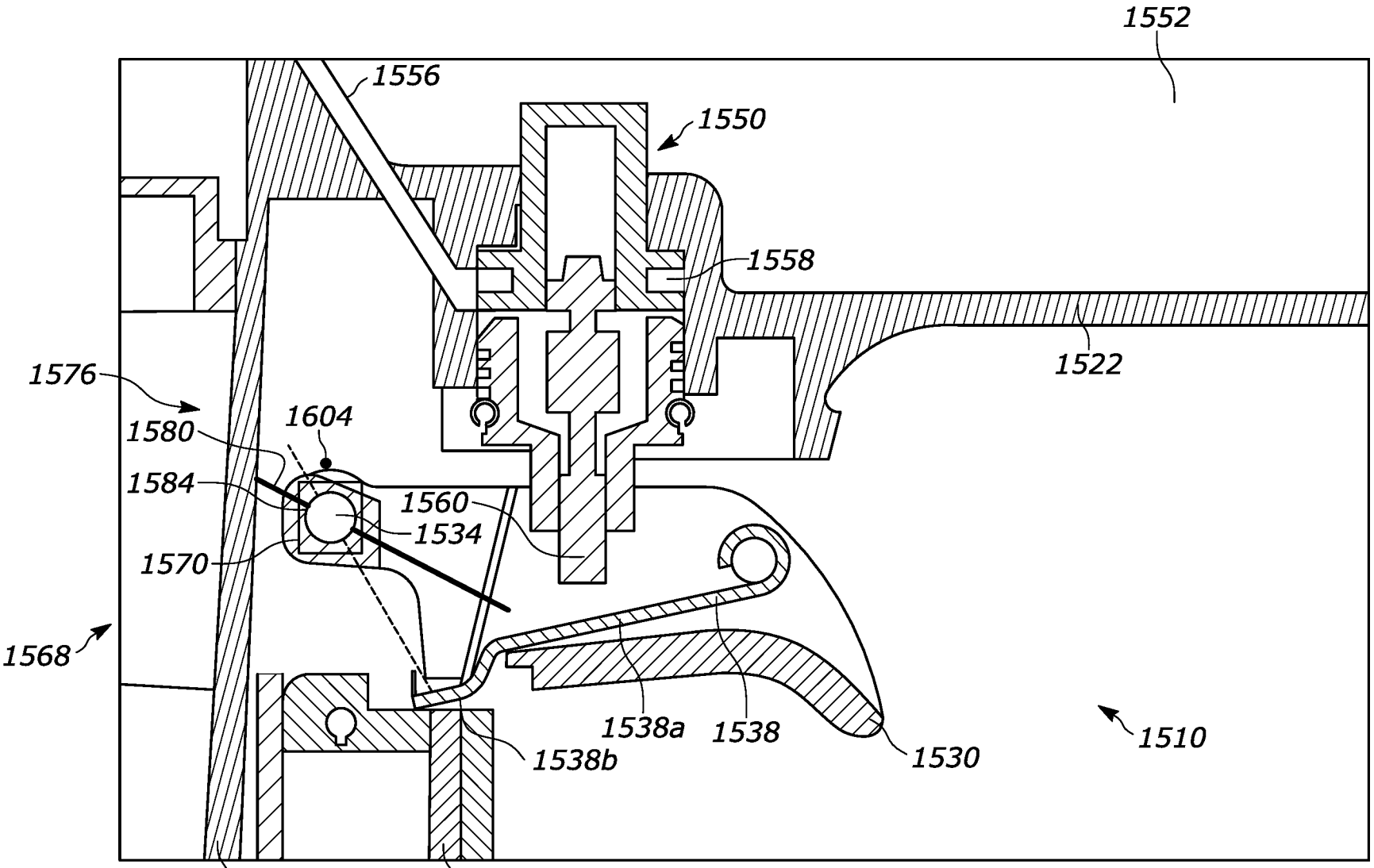
FIG. 24 is a cross-sectional view of a portion of the powered fastener driver of FIG. 21, illustrating the timeout mechanism in the unexpired state, the activation trigger in a depressed position, and the contact arm in the extended position.
Figure 25:
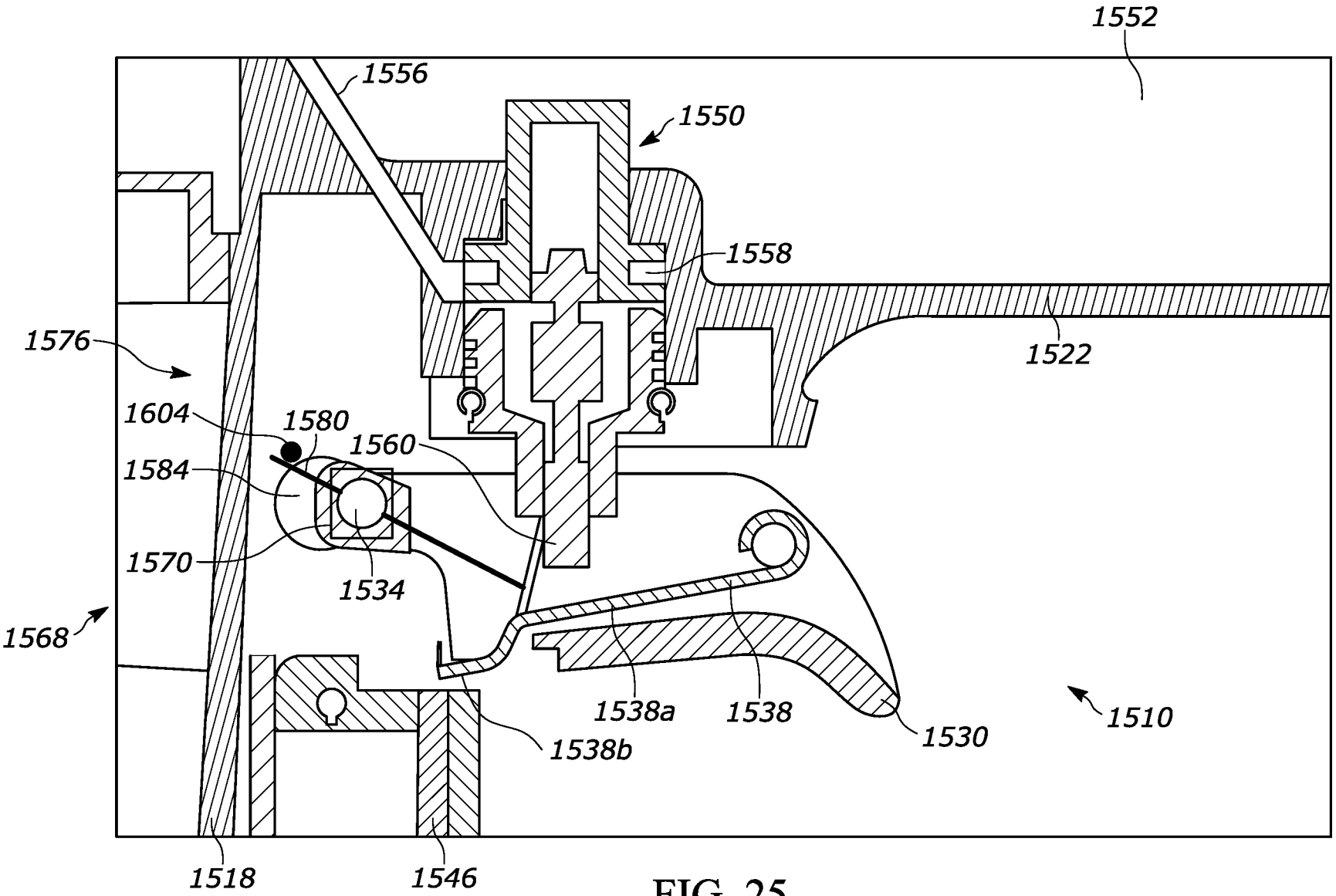
FIG. 25 is a cross-sectional view of a portion of the powered fastener driver of FIG. 21, illustrating the timeout mechanism disengaged from the activation trigger, the activation trigger in the default position, and the contact arm in the extended position.

Now, in the event the operator fails to depresses the contact arm 1546 against a workpiece (i.e., initiates the drive cycle) within the preset time interval, the lockout linkage 1580 rotates in the clockwise direction until contact is made with the support wall 1604 and mechanically interferes with the distal end portion 1538*b* of the trigger arm 1538 at which point the trigger arm 1538 is no longer pivotable to actuate the valve stem 1560, as illustrated in FIG. 24. At this point, the lockout linkage 1580 inhibits the contact arm 1546 from being able to pivot the trigger arm 1538 if an attempt is made to depress the contact arm 1546 after expiration of the preset time interval. At the beginning of the preset time interval, the mainspring 1570 and lockout linkage 1580 are fully wound and the timeout mechanism 1568 is thereby set in motion. The mainspring 1570 and lockout linkage 1580 are slowly unwound (in the clockwise direction) over the preset time interval via the viscous grease between the female barrel 1586 and the pivot shaft 1534. In other words, the counting assembly 1576 is a viscous fluid damper that controls the unwinding of the mainspring 1570 throughout the preset time interval. Eventually, the mainspring 1570 becomes completely unwound and the counting assembly 1576 is in the expired state after, for example, three seconds after initially being set in motion.

When the fastener driver 1510 is in the sequential mode (FIG. 25), the timeout mechanism 1568 is inoperable from engaging with the trigger 1530 such that the operator is not required to initiate the drive cycle within the preset time interval defined by the timeout mechanism 1568. By placing the fastener driver 1510 in sequential mode, the trigger 1530 is displaced relative to the handle portion 1522 via the cammed surface of the knob 66. The female barrel 1586 and the lockout linkage 1580 move with the trigger 1530; however, one of the ends of the lockout linkage 1580 interacts with the support wall 1604, causing the lockout linkage 1580 to pivot towards a permanent position where the lockout linkage 1580 is inhibited from interacting with the trigger arm 1538. Thus, the lockout linkage 1580 is no longer in range to interfere with the trigger arm 1538 of the trigger 1530. As a result, the timeout mechanism 1568 is disabled when the fastener driver 1510 is in the sequential mode. During operation of the fastener driver 1510 in sequential mode, compressed air at high pressure is maintained within the air supply chamber 1552 prior to the activation trigger 1530 being actuated towards the depressed position. Air from the supply chamber 1552 is guided into the trigger air chamber 1558 and the main air passage 1556. Once the contact arm 1546 and the activation trigger 1530 (and therefore the valve stem 1560) are actuated to the depressed position, the trigger air chamber 1558 opens to atmosphere as air exits the trigger valve assembly 1550, allowing the head valve (not shown) to actuate and causing the compressed air from the air supply chamber 1552 to actuate the drive mechanism 29 and the drive blade 28.

Figure 26:
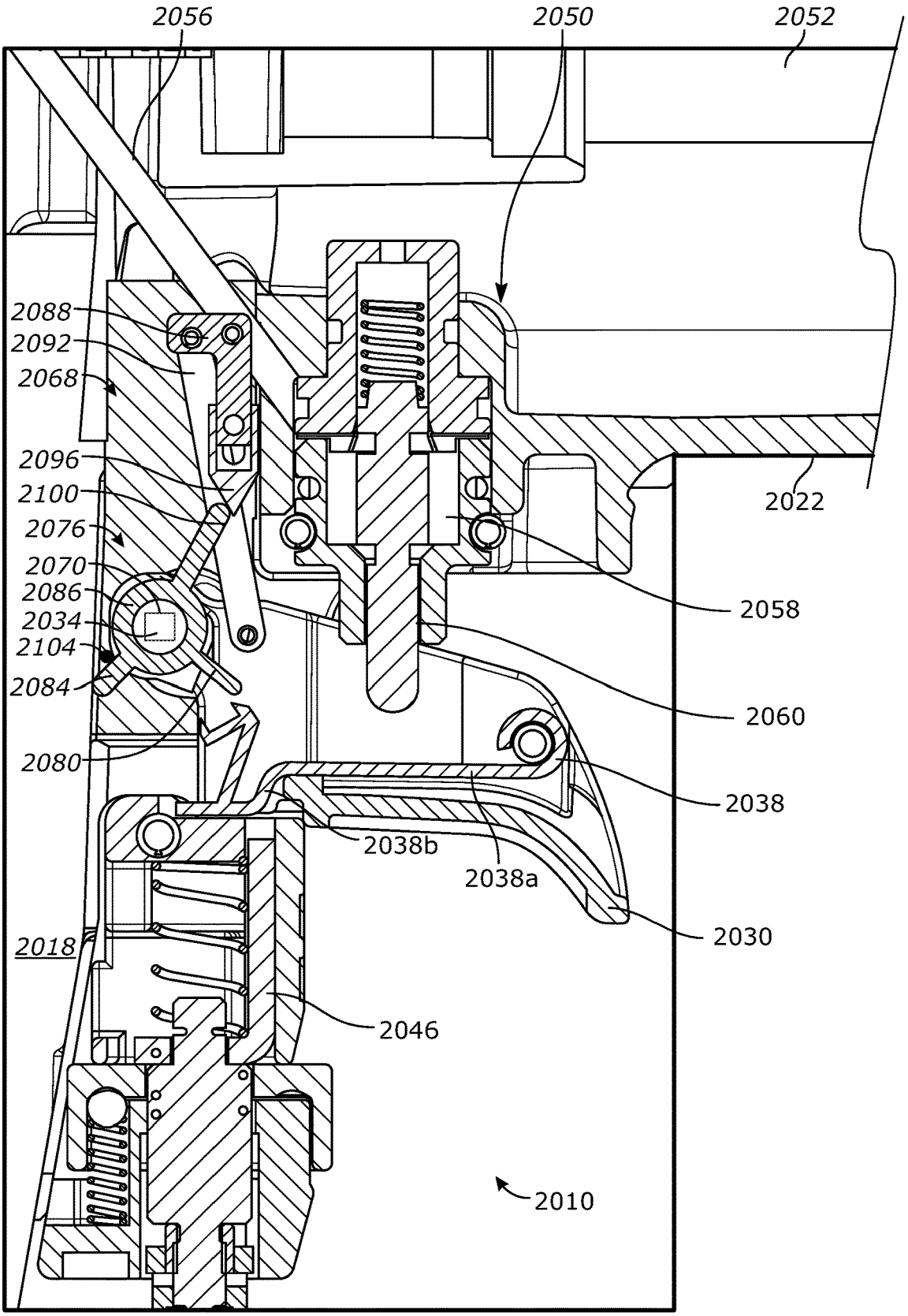
FIG. 26 is a cross-sectional view of a portion of a powered fastener driver in accordance with another embodiment along line 2-2 of FIG. 1, illustrating a timeout mechanism in an expired state, an activation trigger in a default position, and a contact arm in an extended position.

FIG. 26 illustrates a fastener driver 2010 in accordance with another embodiment of the invention. The fastener driver 2010 includes a timeout mechanism 2068 operable to inhibit a drive cycle, but is otherwise similar to the fastener driver 10 described above with reference to FIGS. 1-6, with like components being shown with like reference numerals plus 2000. Differences between the fastener drivers 10, 2010 are described below.

The fastener driver 2010 includes a housing 2018 with a handle portion 2022, an activation trigger 2030, a contact arm 2046, and a trigger valve assembly 2050. The activation trigger 2030 is disposed adjacent the handle portion 2022 and is user-actuated from a default position (FIG. 26) to a depressed position (FIG. 28) to initiate the drive cycle to begin each drive cycle. The contact arm 2046 is also movable between a biased, extended position (FIG. 26) in which fasteners are inhibited from being discharged from the magazine 14, and a retracted position (FIG. 31) in which fasteners are permitted to be discharged from the magazine 14. In the illustrated embodiment, the contact arm 2046 mechanically interfaces with the activation trigger 2030 to selectively permit a drive cycle to be initiated. The trigger valve assembly 2050 is disposed adjacent the activation trigger 2030. High air pressure is released to atmosphere (i.e., atmospheric pressure) through the trigger valve assembly 2050 via the valve stem 2060 when the activation trigger 2030 is actuated, causing the head valve (not shown) to actuate and allowing compressed air stored in the handle portion 2022 to drive the drive blade 28.

The timeout mechanism 2068 is operable to lock the trigger 2030, and more specifically the trigger arm 2038, from being actuated in response to inactivity (i.e., lack of actuation) of the contact arm 2046 over a preset time interval that begins once the trigger 2030 is initially depressed, as described in further detail below. The timeout mechanism 2068 is disposed within the housing 2018 and includes a mainspring 2070 for driving the timeout mechanism 2068, a counting assembly 2076 to control the release of energy from the mainspring 2070, and a lockout linkage 2080 capable of interfacing with the distal end portion 2038*b* of the trigger arm 2038. The lockout linkage 2080 is secured to a female barrel 2086 which, in turn, is pivotably coupled around the pivot shaft 2034 of the trigger 2030. The lockout linkage 2080 rotates with the female barrel 2086 relative to the pivot shaft 2034. The mainspring 2070 urges the lockout linkage 2080 towards the expired state (as shown in FIG. 26), where the trigger linkage 2084 abuts a support wall 2104 of the housing 2018 to prevent the lockout linkage 2080 from pivoting beyond the orientation shown in FIG. 26. The counting assembly 2076 includes a damping grease (e.g., NyoGel® 767A, 774, 774L, lithium grease, etc.) disposed between the pivot shaft 2034 and the female barrel 2086 to effectively control the angular rate (i.e., angular velocity) at which the female barrel 2086 rotates about the pivot shaft 2034. Specifically, the damping grease slows down the angular rate at which the female barrel 2086 rotates about the pivot shaft 2034. The damping grease is operable to slow down the angular rate of rotation between the female barrel 2086 and the pivot shaft 2034 due to its positive viscous properties, thereby creating friction (i.e., opposing relative motion) between the surfaces of the barrel 2084 and the shaft 2034.

Figure 34:
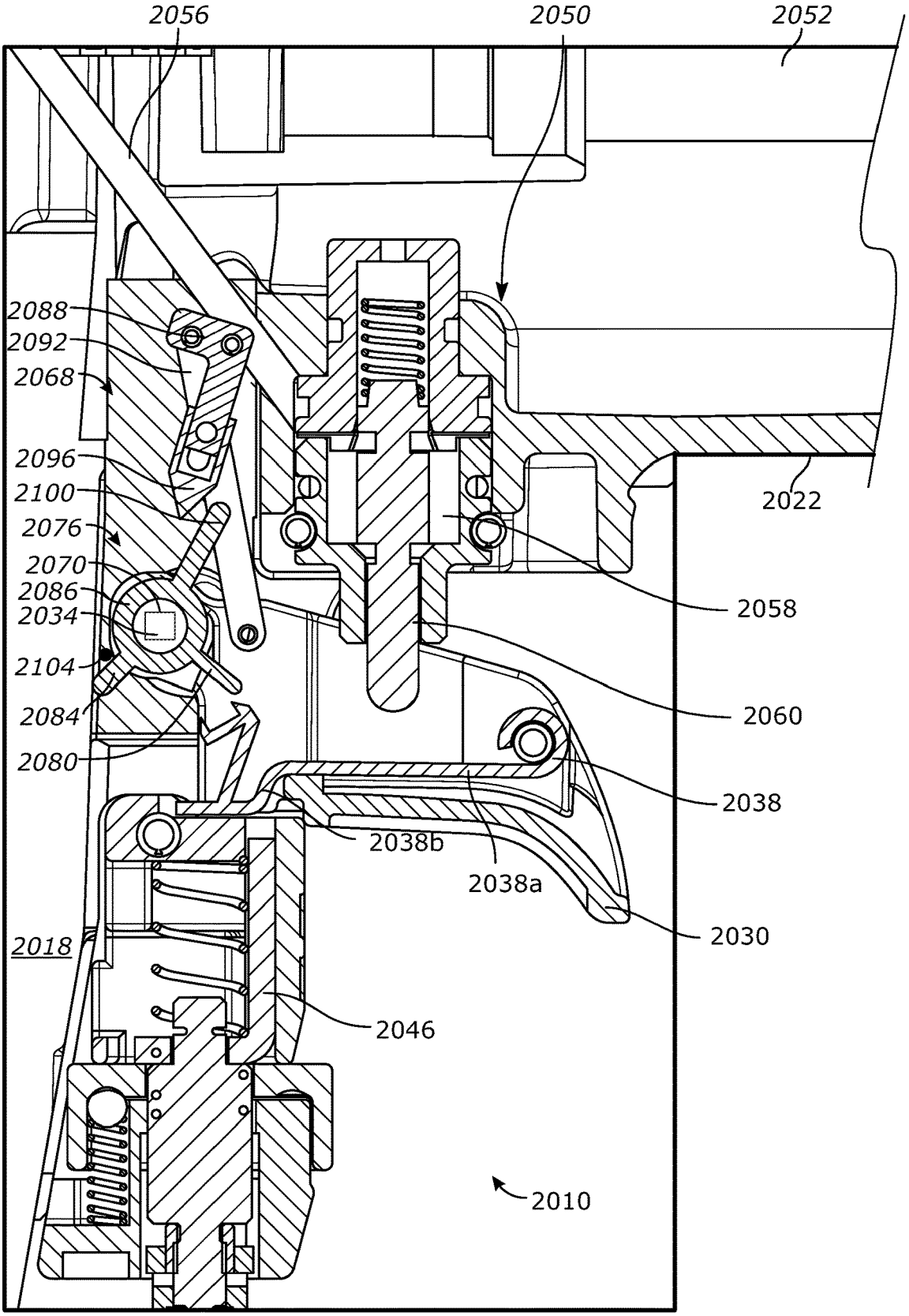
FIG. 34 is a cross-sectional view of a portion of the powered fastener driver of FIG. 26, illustrating the timeout mechanism in the expired state, the activation trigger in the default position, and the contact arm in the extended position.
Figure 35:
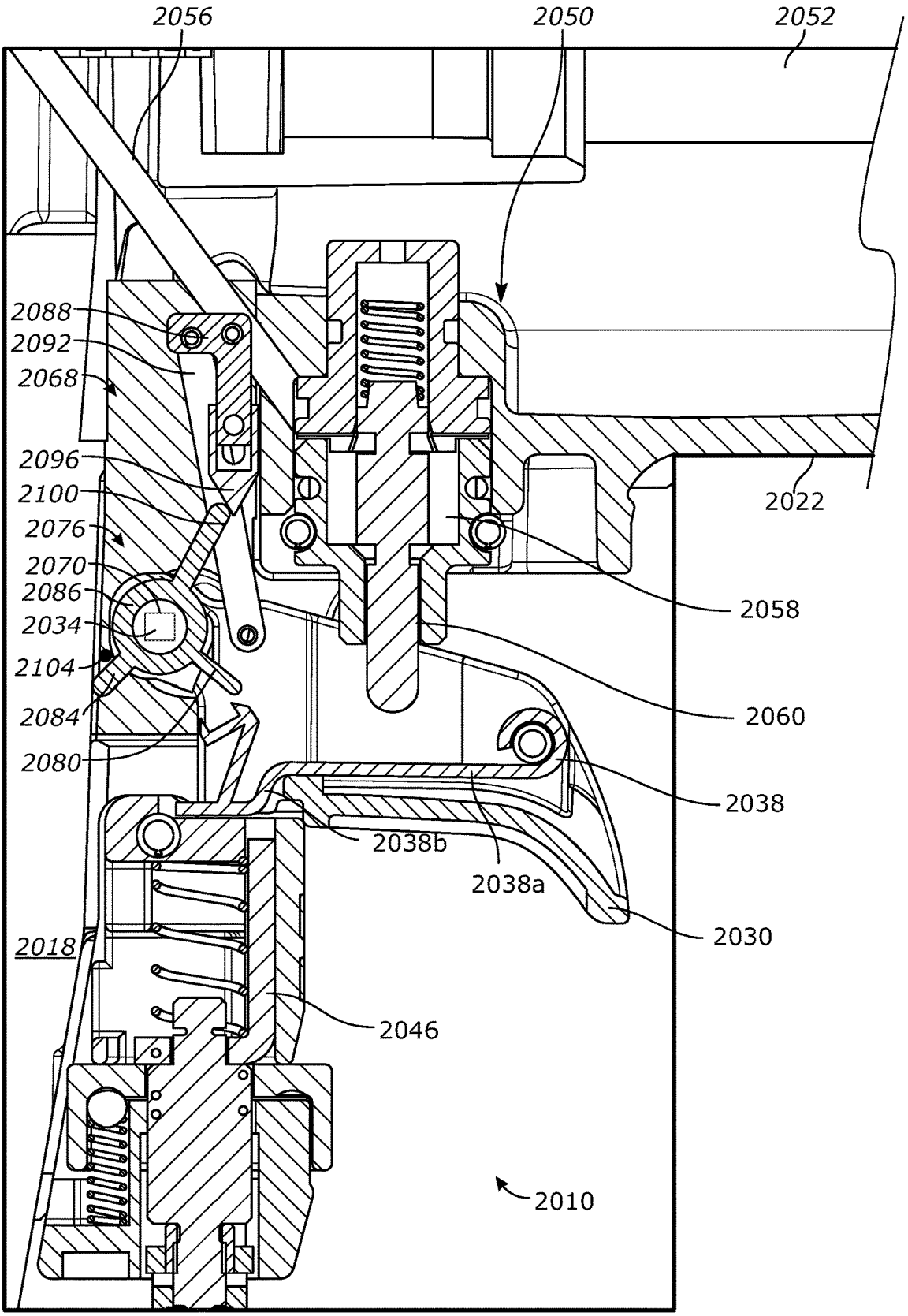
FIG. 35 is a cross-sectional view of a portion of the powered fastener driver of FIG. 26, illustrating the timeout mechanism in the expired state, the activation trigger in the default position, and the contact arm in the extended position.

The timeout mechanism 2068 further includes a 3-bar linkage system, where the trigger 2030 constitutes one of the linkages, a second linkage 2088 is pivotably coupled to the housing 2018, and a third linkage 2092 is pivotably coupled between both the trigger 2030 and the third linkage 2088. The trigger 2030 drives movement of the second and third linkages 2088, 2092. For example, the third linkage 2092 is driven upwardly when the trigger 2030 is depressed to the depressed position, causing the second linkage 2088 to rotate in a clockwise direction. In contrast, the third linkage 2092 is driven downwardly when the trigger 2030 is released to the default position, causing the second linkage 2088 to rotate in the counter-clockwise direction. The second linkage 2088 includes a compressible tip 2096 that is selectively engageable with a projection 2100 of the female barrel 2086. The compressible tip 2096 is slidable between a first position (FIG. 26) and a second position (FIG. 34). Although the compressible tip 2096 of the illustrated embodiment is slidable between the first and second positions, in other embodiments, the tip 2096 could alternatively be a deformable tip that deflects between first and second positions.

Figure 27:
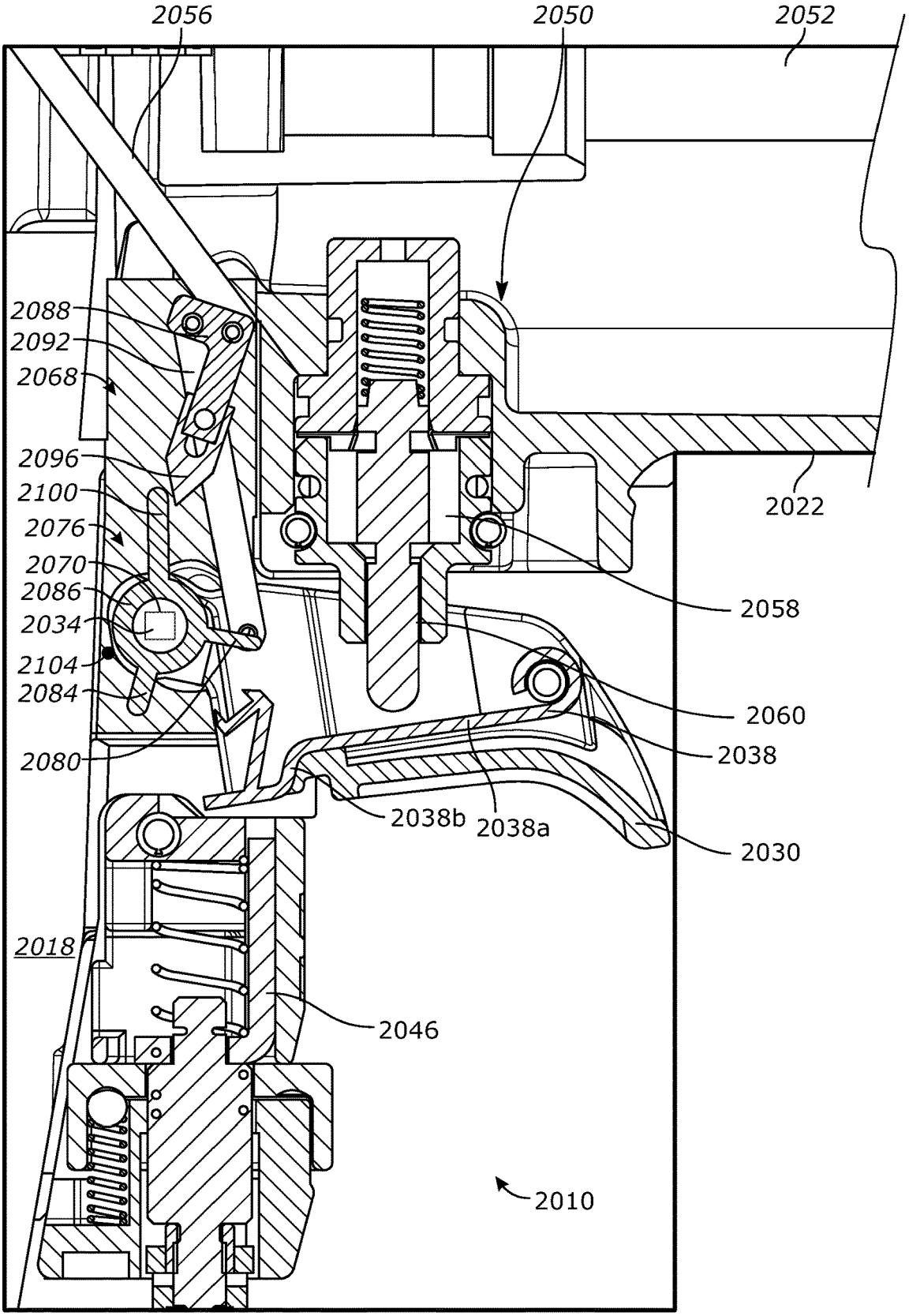
FIG. 27 is a cross-sectional view of a portion of the powered fastener driver of FIG. 26, illustrating the timeout mechanism in an unexpired state, the activation trigger in a depressed position, and the contact arm in the extended position.
Figure 28:
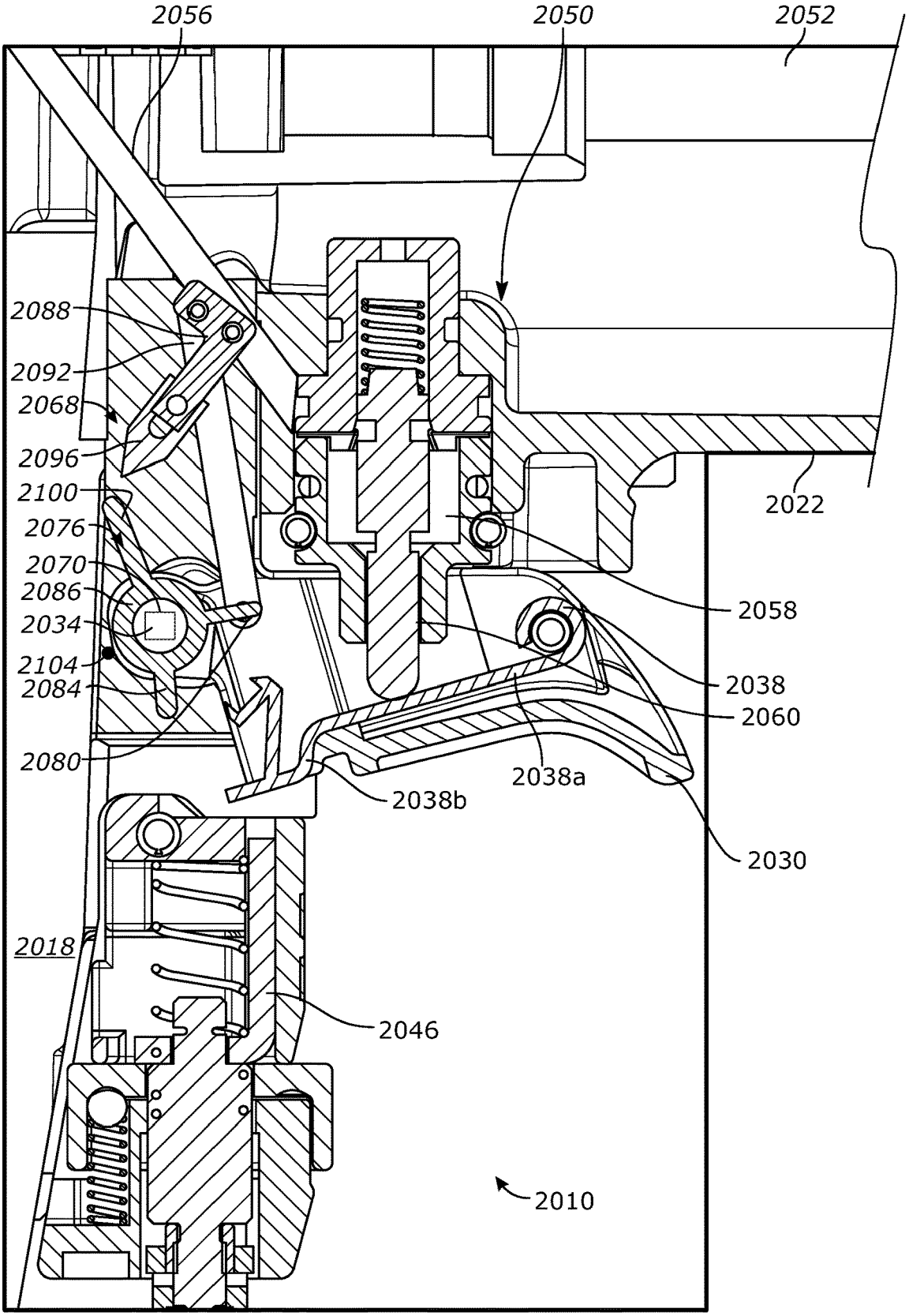
FIG. 28 is a cross-sectional view of a portion of the powered fastener driver of FIG. 26, illustrating the timeout mechanism in the unexpired state, the activation trigger in the depressed position, and the contact arm in the extended position.
Figure 29:
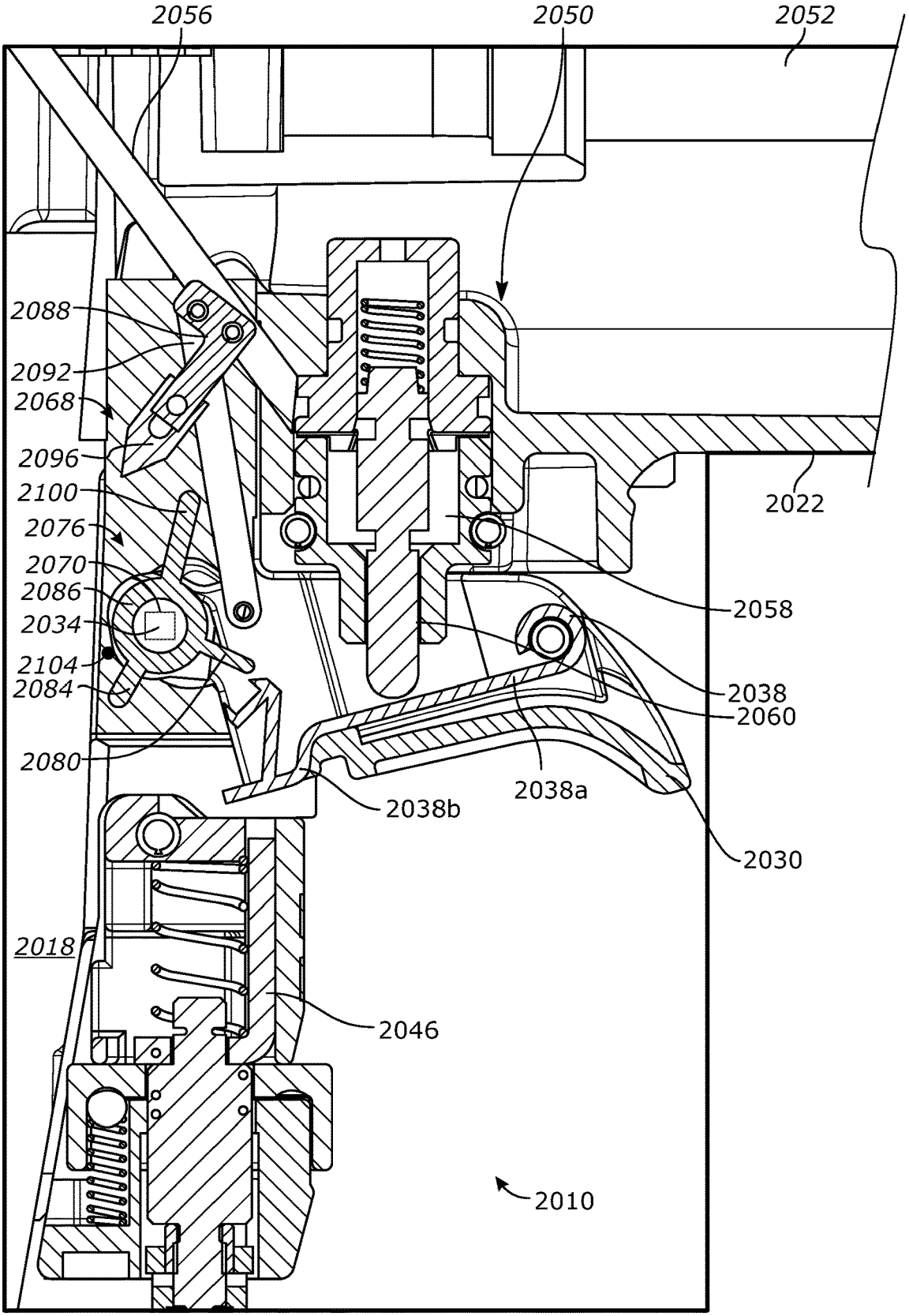
FIG. 29 is a cross-sectional view of a portion of the powered fastener driver of FIG. 26, illustrating the timeout mechanism in the unexpired state, the activation trigger in the depressed position, and the contact arm in the extended position.

In operation, the fastener driver 2010 is operable in two modes of operation—a first or single sequential mode and a second or bump-fire mode (FIGS. 26-35). While the fastener driver 2010 is in bump-fire mode, the timeout mechanism 2068 limits the amount of time an operator has to initiate a drive cycle (i.e., depress the contact arm 2046 against a workpiece) after the trigger 2030 is actuated to the depressed position. As illustrated in FIG. 26, the trigger 2030 is in the default position and the lockout linkage 2080 is adjacent the distal end portion 2038*b* of the trigger arm 2038. At this point, the mainspring 2070 is unwound, and thus the counting assembly 2076 is in the expired state. By actuating the trigger 2030 to the depressed position as illustrated in FIGS. 27 and 28, the lockout linkage 2080 (and therefore the female barrel 2086) is rotated in a counter-clockwise direction away from the distal end portion 2038*b* of the trigger arm 2038, which ultimately winds the mainspring 2070 and places the counting assembly 2076 in an unexpired state. Specifically, the lockout linkage 2080 is rotated in the counter-clockwise direction as the second linkage 2088 exerts a torsional force on the projection 2100 of the female barrel 2086 by way of the trigger 2030 and third linkage 2092 being actuated. Once the trigger 2030 is in the depressed position, the compressible tip 2096 of the second linkage 2088 no longer interferes with the projection 2100 of the female barrel 2086; thus activating the preset time interval (FIG. 28).

Figure 30:
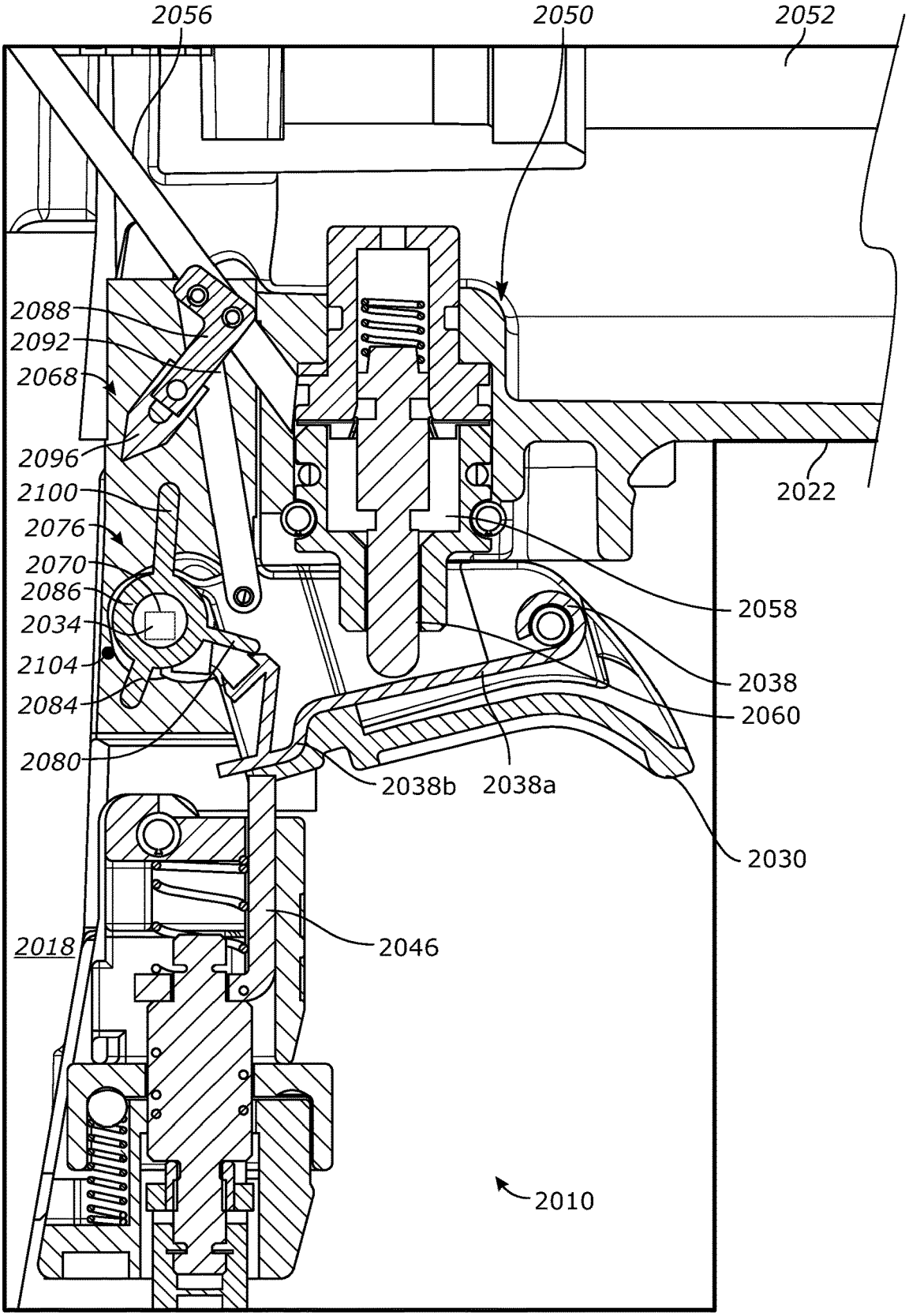
FIG. 30 is a cross-sectional view of a portion of the powered fastener driver of FIG. 26, illustrating the timeout mechanism in the unexpired state, the activation trigger in the depressed position, and the contact arm in the retracted position.
Figure 31:
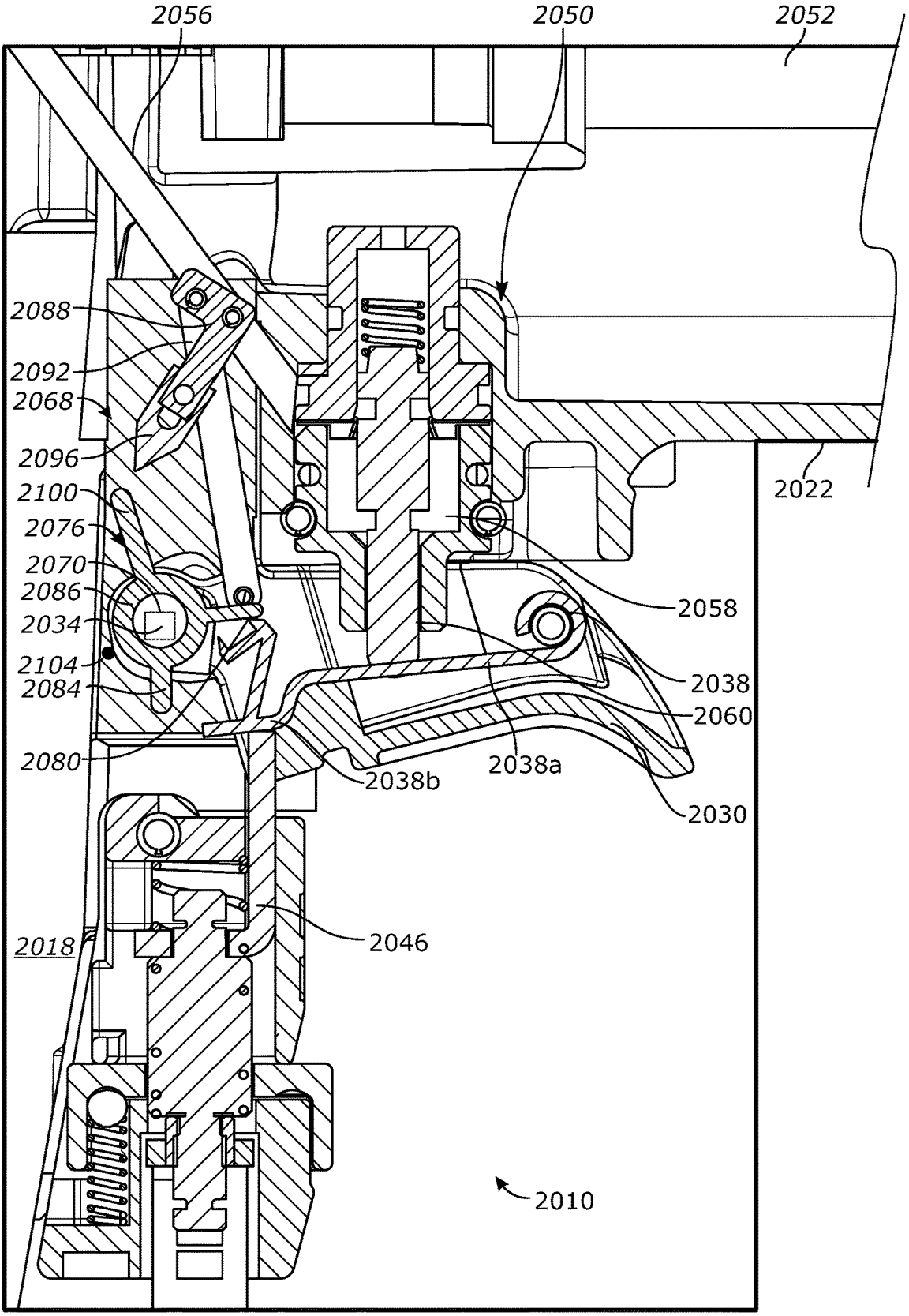
FIG. 31 is a cross-sectional view of a portion of the powered fastener driver of FIG. 26, illustrating the timeout mechanism in the unexpired state, the activation trigger in the depressed position, and the contact arm in the retracted position.
Figure 32:
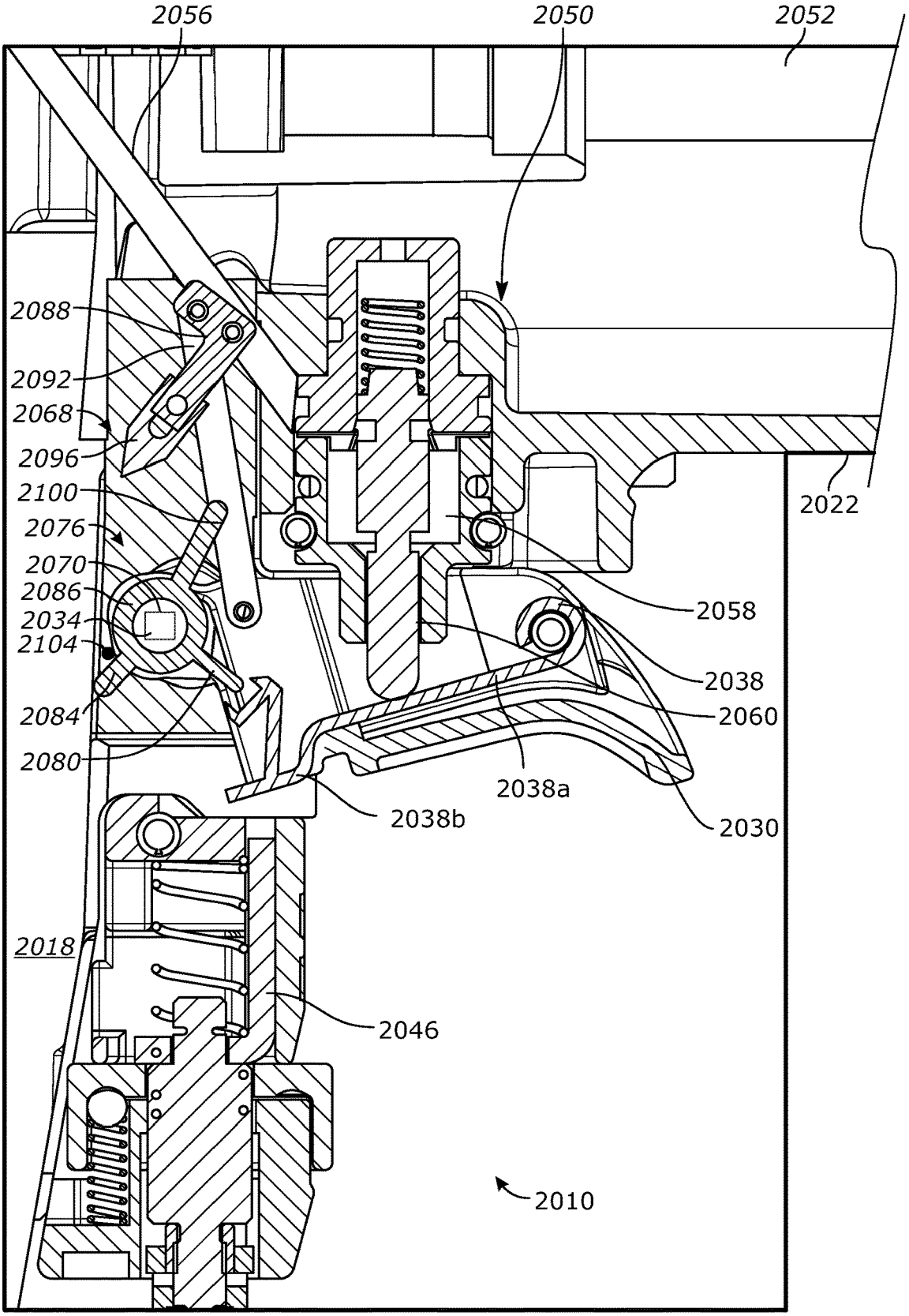
FIG. 32 is a cross-sectional view of a portion of the powered fastener driver of FIG. 26, illustrating the timeout mechanism in the expired state, the activation trigger in the depressed position, and the contact arm in the extended position.

At this point, the mainspring 2070 and the lockout linkage 2080 are fully wound, thereby starting the preset time interval during which the operator is permitted to initiate the drive cycle. In the event the operator depresses the contact arm 2046 against a workpiece (i.e., initiates the drive cycle) as illustrated in FIGS. 30 and 31, the contact arm 2046 contacts the distal end portion 2038*b* of the trigger arm 2038, causing rotation of the trigger arm 2038 towards the valve stem 2060 at which point the central portion 2038*a* of the trigger arm 2038 actuates the valve stem 2060. Subsequently, the drive mechanism 29 drives the drive blade 28 to discharge a fastener through the nosepiece 2026 and into the workpiece. When the contact arm 2046 contacts the distal end portion 2038*b*, the contact arm 2038 simultaneously pushes the distal end portion 2038*b* into contact with the lockout linkage 2080 to rotate the linkage 2080 counter-clockwise back towards the unexpired state, thereby resetting the timeout mechanism 2068 since the mainspring 2070 is fully wound again.

Figure 33:
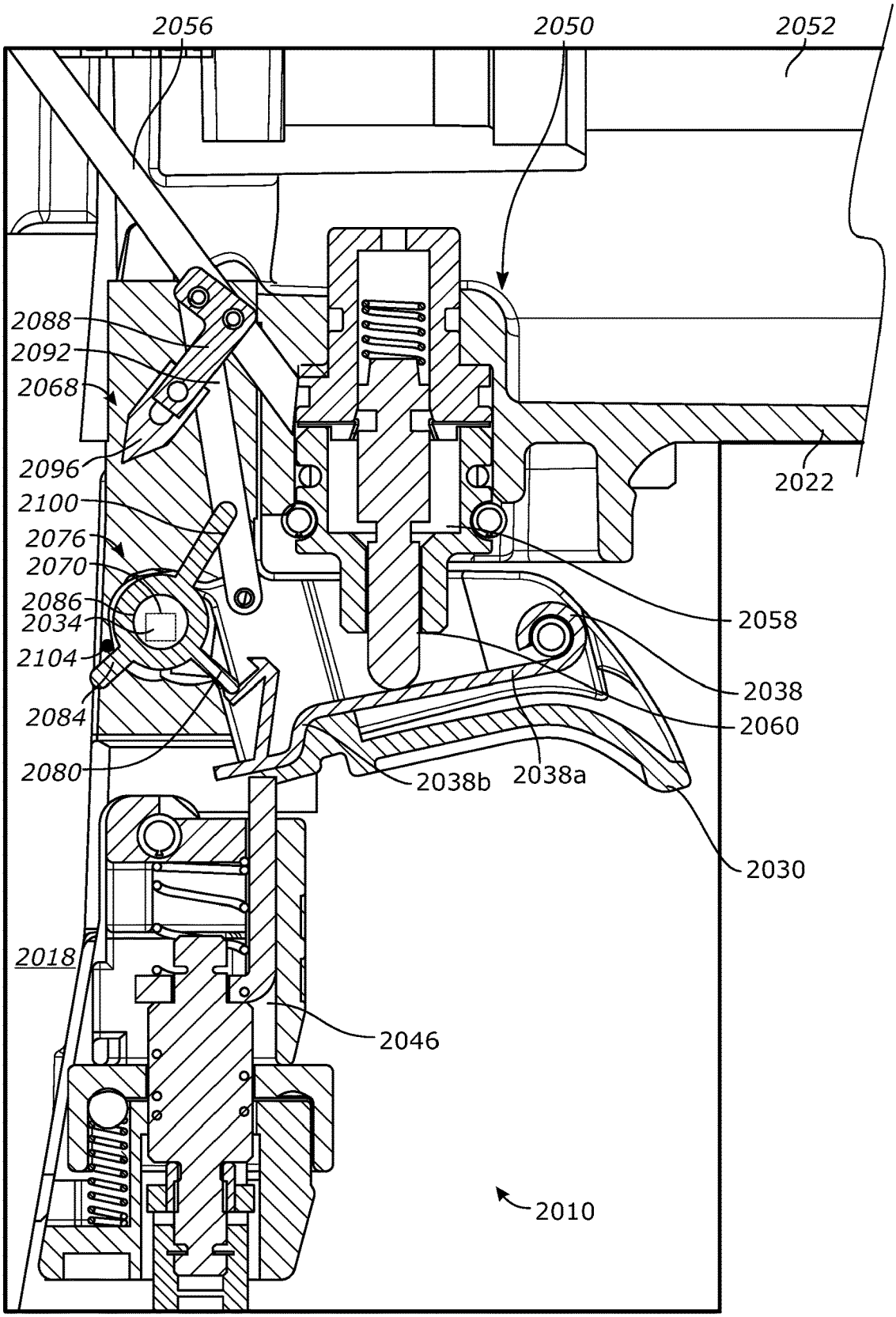
FIG. 33 is a cross-sectional view of a portion of the powered fastener driver of FIG. 26, illustrating the timeout mechanism in the expired state, the activation trigger in the depressed position, and the contact arm in the extended position.

Now, in the event the operator fails to depresses the contact arm 2046 against a workpiece (i.e., initiates the drive cycle) within the preset time interval, the lockout linkage 2080 rotates clockwise until contact is made with the support wall 2104 (FIG. 32) and mechanically interferes with the distal end portion 2038*b* of the trigger arm 2038 at which point the trigger arm 2038 is no longer pivotable to actuate the valve stem 2060, as illustrated in FIG. 33. At this point, the lockout linkage 2080 inhibits the contact arm 2046 from being able to pivot the trigger arm 2038 if an attempt is made to depress the contact arm 2046 after expiration of the preset time interval. At the beginning of the preset time interval, the mainspring 2070 and lockout linkage 2080 are fully wound and the timeout mechanism 2068 is thereby set in motion. The mainspring 2070 and lockout linkage 2080 are slowly unwound (in the clockwise direction) over the preset time interval via the viscous grease between the female barrel 2086 and the pivot shaft 2034. In other words, the counting assembly 2076 is a viscous fluid damper that controls the unwinding of the mainspring 2070 throughout the preset time interval. Eventually, the mainspring 2070 becomes completely unwound and the counting assembly 2076 is in the expired state after, for example, three seconds after initially being set in motion.

When the fastener driver 2010 is in the sequential mode, the timeout mechanism 2068 is inoperable from engaging with the trigger 2030 such that the operator is not required to initiate the drive cycle within the preset time interval defined by the timeout mechanism 2068. By placing the fastener driver 2010 in sequential mode, the trigger 2030 is displaced relative to the handle portion 2022 via the cammed surface of the knob 66. The lockout linkage 2080 and the third linkage 2092 move with the trigger 2030, causing the second linkage 2088 to pivot towards a permanent position where the lockout linkage 2080 is inhibited from interacting with the trigger arm 2038. Thus, the lockout linkage 2080 is no longer in proximity to interfere with the trigger arm 2038 of the trigger 2030. As a result, the timeout mechanism 2068 is disabled when the fastener driver 2010 is in the sequential mode. During operation of the fastener driver 2010 in sequential mode, compressed air at high pressure is maintained within the air supply chamber 2052 prior to the activation trigger 2030 being actuated towards the depressed position. Air from the supply chamber 2052 is guided into the trigger air chamber 2058 and the main air passage 2056. Once the contact arm 2046 and the activation trigger 2030 (and therefore the valve stem 2060) are actuated to the depressed position, the trigger air chamber 2058 opens to atmosphere as air exits the trigger valve assembly 2050, allowing the head valve (not shown) to actuate and causing the compressed air from the air supply chamber 2052 to actuate the drive mechanism 29 and the drive blade 28.

Although the invention has been described in detail with reference to certain preferred embodiments, variations and modifications exist within the scope and spirit of one or more independent aspects of the invention as described.

What is claimed is:

1. A pneumatic fastener driver operable in a single sequential mode and a bump-fire mode, the pneumatic fastener driver comprising:

a housing;

a nosepiece extending from the housing from which fasteners are ejected;

a trigger moveable between a default position, in which a drive cycle is inhibited from initiating, and a depressed position, in which the drive cycle is permitted to be initiated;

a contact arm movable relative to the nosepiece between an extended position and a retracted position; and a timeout mechanism operable in the bump-fire mode to inhibit the drive cycle from being initiated in response to inactivity of the contact arm over a preset time interval that begins once the trigger is actuated from the default position to the depressed position.

2. The fastener driver of claim 1, further comprising a counting assembly that defines the preset time interval when the counting assembly is in an unexpired state, and wherein the counting assembly is in an expired state during inactivity of the counting assembly.

3. The fastener driver of claim 2, wherein the counting assembly is maintained in the unexpired state in response to actuation of the contact arm from the extended position to the retracted position before the preset time interval has elapsed.

4. The fastener driver of claim 3, wherein the timeout mechanism includes a mainspring, a gear train that is driven by the mainspring during the unexpired state, and a lockout linkage moveable via the gear train to interfere with a portion of the trigger when the counting assembly is in the expired state.

5. The fastener driver of claim 4, wherein the counting assembly includes a hairspring assembly and an escapement wheel to control the energy release of the mainspring.

6. The fastener driver of claim 5, further including a palette lever that intermittently engages with the escapement wheel to decrementally release the energy from the mainspring.

7. The fastener driver of claim 4, wherein the counting assembly includes a gas spring assembly to control the energy release of the mainspring.

8. The fastener driver of claim 7, further comprising a cylinder containing compressed gas and a piston rod sealed within the cylinder that resists external forces applied parallel to the direction of the piston rod in response to the piston rod translating through the compressed gas.

9. The fastener driver of claim 3, wherein the timeout mechanism includes a mainspring, a female barrel pivotably coupled around a pivot shaft of the trigger and driven by the mainspring during the unexpired state, and a lockout linkage moveable via the female barrel to interfere with a portion of the trigger when the counting assembly is in the expired state.

10. The fastener driver of claim 9, wherein the counting assembly includes a damping grease disposed between the pivot shaft and the female barrel to effectively control the angular velocity at which the female barrel rotates relative to the pivot shaft.

11. The fastener driver of claim 3, further comprising a trigger arm pivotably coupled to the trigger, wherein the trigger arm is selectively urged by the contact arm to initiate a drive cycle when the trigger is in the depressed position.

12. The fastener driver of claim 1, further comprising a trigger valve assembly disposed adjacent the trigger, wherein high air pressure is released to atmosphere through the trigger valve assembly to initiate the drive cycle.

13. The fastener driver of claim 12, further comprising an air supply chamber disposed in the housing that stores the high air pressure, which is released through the trigger valve assembly to initiate the drive cycle.

14. The fastener driver of claim 12, further comprising a timeout air chamber that fills with pressurized air in response to the trigger moving to the depressed position, thereby causing an air-lock pin to be biased towards an unblocking position where the high air pressure is permitted to escape through the trigger valve assembly.

15. The fastener driver of claim 14, further comprising a sled disposed within the timeout air chamber biased toward an extended position by a spring and toward a retracted position by the pressurized air that selectively fills the timeout air chamber, wherein the air-lock pin is urged towards the unblocking position when the sled is in the retracted position.

16. The fastener driver of claim 15, wherein the timeout air chamber includes an orifice through which the pressurized air slowly leaks over the preset time interval, causing the lockout pin to gradually move towards the blocking position.

17. The fastener driver of claim 1, wherein the timeout mechanism is deactivated in the single sequential mode.

18. A pneumatic fastener driver operable in a single sequential mode and a bump-fire mode, the pneumatic fastener driver comprising:

a housing;

a nosepiece extending from the housing from which fasteners are ejected;

a trigger moveable between a default position, in which a drive cycle is inhibited from initiating, and a depressed position, in which the drive cycle is permitted to be initiated;

a contact arm movable relative to the nosepiece between an extended position and a retracted position; and a timeout mechanism operable in the bump-fire mode to inhibit actuation of the contact arm towards the retracted position in response to inactivity of the contact arm over a preset time interval that begins once the trigger is actuated from the default position to the depressed position.

19. The fastener driver of claim 18, further comprising a counting assembly that defines the preset time interval when the counting assembly is in an unexpired state, and wherein the counting assembly is in an expired state during inactivity of the counting assembly.

20. The fastener driver of claim 19, wherein the counting assembly is maintained in the unexpired state in response to actuation of the contact arm towards the retracted position before the preset time interval has elapsed.

* * * * *